US011898351B2

(12) United States Patent
Satchell et al.

(10) Patent No.: US 11,898,351 B2
(45) Date of Patent: Feb. 13, 2024

(54) JOIST TIE USED IN STRUCTURAL DECKING SYSTEMS AND METHOD OF INSTALLING

(71) Applicant: NUCOR CORPORATION, Charlotte, NC (US)

(72) Inventors: Terence Lee Satchell, Gladsen, AL (US); Daniel Joseph Watkins, Fort Payne, AL (US)

(73) Assignee: NUCOR CORPORATION, Charlotte, NC (US)

( * ) Notice: Subject to any disclaimer, the term of this patent is extended or adjusted under 35 U.S.C. 154(b) by 200 days.

(21) Appl. No.: 16/597,458

(22) Filed: Oct. 9, 2019

(65) Prior Publication Data

US 2020/0115899 A1 Apr. 16, 2020

Related U.S. Application Data

(60) Provisional application No. 62/743,812, filed on Oct. 10, 2018.

(51) Int. Cl.
*E04C 3/02* (2006.01)
*E04B 1/24* (2006.01)

(52) U.S. Cl.
CPC ..... *E04C 3/02* (2013.01); *E04B 2001/2415* (2013.01); *E04B 2001/2457* (2013.01)

(58) Field of Classification Search
CPC .. E04B 5/40; E04B 2001/2415; E04B 1/2403; E04B 1/2608; E04B 1/5818; E04B 2001/2448; E04B 2001/2457; E04B 2001/246; E04C 3/02
See application file for complete search history.

(56) References Cited

U.S. PATENT DOCUMENTS 910,757 A * 1/1909 Wilson ..... E04B 5/40 52/336
2,155,709 A * 4/1939 Patterson ..... E04B 1/24 52/262
2,473,976 A * 6/1949 Timm ..... E04C 3/09 52/635

(Continued)

FOREIGN PATENT DOCUMENTS

DE 1110473 B * 7/1961 ..... A47B 47/03
DE 102005001336 A1 * 7/2006 ..... E04D 12/006

(Continued)

*Primary Examiner* — Brian D Mattei
*Assistant Examiner* — Charissa Ahmad
(74) *Attorney, Agent, or Firm* — Moore & Van Allen PLLC; Jeffrey R. Gray

(57) ABSTRACT

A joist tie may be designed to increase the strength of the joist tie and reduce the thickness of the joist tie, in order to provide the desired strength and the ability to make connections that operatively couple structural decking, the joist tie, and joists together using a single connector in one or more locations. The joist tie may be strengthened through the use of one or more ribs and/or one or more flanges. The one or more ribs may be formed to fit within one or more cavities within adjacent joists located in series. As such, the shape of the joist tie may be dimensioned in order to allow the joist tie to be placed on a first joist and a second joist without having to be attached until after assembly of the structural decking on top of the joist tie and joists.

21 Claims, 14 Drawing Sheets

(56) References Cited

U.S. PATENT DOCUMENTS 3,527,007 A 9/1970 Mcmanus
3,624,980 A 12/1971 Mcmanus
3,683,580 A * 8/1972 McManus ..... E04B 1/41 52/334
3,812,636 A * 5/1974 Albrecht ..... E04D 3/30 52/334
3,945,741 A 3/1976 Wendt
3,977,149 A * 8/1976 Haynes ..... E04C 3/20 52/579
4,056,908 A 11/1977 Mcmanus
4,069,638 A * 1/1978 Hasselqvist ..... B21C 37/104 403/231
4,114,335 A * 9/1978 Carroll ..... E04B 2/60 52/302.1
4,330,106 A * 5/1982 Chisholm ..... E01F 15/0423 256/13.1
4,464,074 A 8/1984 Green et al.
4,476,662 A 10/1984 Fisher
4,597,233 A * 7/1986 Rongoe, Jr. ..... E04B 5/29 52/336
4,715,155 A 12/1987 Holtz
4,726,159 A * 2/1988 Stohs ..... E04B 5/40 174/489
4,741,134 A 5/1988 Stohs
4,741,138 A * 5/1988 Rongoe, Jr. ..... E04B 5/40 52/336
4,773,192 A * 9/1988 Andrews ..... E04B 1/24 52/93.1
4,887,406 A * 12/1989 Saia ..... E04B 7/024 52/693
4,894,967 A 1/1990 Morton
5,152,507 A * 10/1992 Lee ..... E01F 13/026 256/13.1
5,385,423 A * 1/1995 Abukawa ..... F16B 9/05 403/245
6,131,359 A 10/2000 Duff
6,332,299 B1 12/2001 Stewart
6,415,581 B1 7/2002 Shipman et al.
6,928,782 B2 * 8/2005 Becker ..... E04C 3/08 52/696
7,389,620 B1 * 6/2008 McManus ..... E04B 5/40 52/414
7,530,548 B2 * 5/2009 Ochoa ..... E01F 15/0423 256/13.1
7,987,647 B2 * 8/2011 Rymell ..... E04D 3/3608 52/506.06
8,230,657 B2 * 7/2012 Studebaker ..... E04B 1/165 52/319
8,529,178 B2 * 9/2013 Dayton ..... E04C 3/11 411/386
8,776,469 B2 * 7/2014 Morey ..... F16B 7/0493 52/506.06
8,973,332 B2 * 3/2015 Lee ..... E04B 1/1903 52/653.2
9,163,392 B2 * 10/2015 Wilson ..... E04B 1/32
9,209,609 B2 * 12/2015 Kellerman ..... E04B 1/5812
9,803,351 B2 * 10/2017 Ledford ..... E04B 2/60
10,190,308 B2 * 1/2019 De Almeida Borges ..... E04C 3/08
10,378,164 B2 * 8/2019 Flint ..... B32B 3/28
10,557,266 B2 * 2/2020 Carr ..... E04C 3/09
10,648,167 B2 * 5/2020 Satchell ..... E04B 5/10
11,180,919 B1 * 11/2021 Nelson, Jr. ..... E04D 3/30
2009/0188187 A1 * 7/2009 Studebaker ..... F16B 5/0275 411/383
2009/0188208 A1 * 7/2009 Studebaker ..... F16B 25/0094 52/852
2010/0086348 A1 * 4/2010 Funahashi ..... H02G 3/0456 403/306
2010/0139201 A1 6/2010 Strickland et al.
2011/0203217 A1 * 8/2011 Dayton ..... F16B 7/185 52/705
2011/0289878 A1 * 12/2011 Morey ..... E04C 3/02 52/653.2
2012/0073213 A1 * 3/2012 Studebaker ..... F16B 35/048 52/73
2012/0291378 A1 11/2012 Schroeder, Sr. et al.
2014/0123587 A1 * 5/2014 Lee ..... E04B 1/1903 52/655.1

FOREIGN PATENT DOCUMENTS

GB 1562688 A * 3/1980 ..... E04B 1/24
GB 2169937 A * 7/1986 ..... E04B 1/5818
WO WO-2017219104 A1 * 12/2017 ..... E04C 2/40

* cited by examiner

*FIG.* 11

JOIST TIE USED IN STRUCTURAL DECKING SYSTEMS AND METHOD OF INSTALLING

CROSS REFERENCE AND PRIORITY CLAIM UNDER 35 U.S.C. § 119

The present application for a patent claims priority to U.S. Provisional Patent Application Ser. No. 62/743,812 entitled "Joist Tie Used in Structural Decking Systems and Method of Installing," filed on Oct. 10, 2018 and assigned to the assignees hereof and hereby expressly incorporated by reference herein.

FIELD

This application relates generally to the field of structural decking systems (otherwise described as structural panel systems), and more particularly, to improvements to the strength and assembly of the structural decking systems due to an improved joist tie between the ends of adjacent joists located in series at a support member.

BACKGROUND

Structural panels are used in commercial or industrial construction (and in some cases residential construction), for example, as a component of poured concrete floors or as structural roofing (e.g., for commercial buildings, industrial buildings, institutional buildings, or the like). Structural panels may typically be manufactured from steel sheets, which may or may not be coiled. In order to increase the structural strength and the stiffness of the individual steel sheets, structural panels with longitudinal profiles are formed from the steel sheets via roll forming, break forming, bending, stamping, or other like processes. The structural panels are secured to each other in order to form the structural steel panel system when installed. These structural panels may be used as roof decking, floor decking, or wall panels. As such, corrugated structural panels may be used in a variety of building applications.

The panels are connected to the other load resisting support members of a building, such as joists, which are in turn connected to other support members, such as other joists (e.g., larger joists), girders, beams, walls, other structural members, or the like. When the panels are connected to each other and the various support members in a secure manner for roof, floor, or wall applications, the assembled structural steel decking system provides considerable diaphragm (or membrane) strength, which is used to transfer horizontal loads to the vertical and lateral load carrying components of the building. However, improved structural decking systems and methods of assembly are needed.

BRIEF SUMMARY

A joist typically comprises of an upper chord, lower chord, and a web, which operatively couples the upper chord to the lower chord. The opposing ends of the joist (e.g., a proximal end and a distal end) may include a joist seat (otherwise described as a joist shoe). It should be understood that the joist seat may be formed in a number of different ways. For example, in typical configurations the joist seat may comprise of a portion of the upper chord that is operatively coupled to seat chord (e.g., a second chord that mates with the support member). It should be understood that the upper chord may be operatively coupled directly to the seat chord, or it may be spaced apart from the seat chord through the use of webs. In other embodiments of the invention the joist seat may be formed from an upper seat chord and a lower seat chord that are separate from the upper chord.

Regardless of the configuration of the joist seats, the joist seats of joists located in series at the support member may be operatively coupled together. By coupling the joist seats together, a continuous connection is created to form a sub-diaphragm in order to resist axial forces in the chords due to lateral loading. The axial load at a support member may be required to be transferred from a joist seat on one end of a first joist to a joist seat on a second joist across the top of the support member (e.g., another larger joist, girder, beam, or the like). This may be accomplished by transferring the force through the joist seat of a first joist, into the support member, and back into the second joist seat. This creates transfer forces that are unaccounted for in designing the building and connections thereof. Alternatively, axial transfer members (e.g., a steel plate, angles—"L-shaped" members, rods, rebar, or the like) may connect one joist in series to an adjacent joist at a support member. For example, a steel plate may connect the top of an upper chord of a first joist and the top of upper chord of a second joist. Alternatively, angles (e.g., "L-shaped" members, or the like), plates, bars, or other like axial transfer members may be connected between the joists (e.g., joists seats and/or ends of the joists), such as under the top of the chords of the first joist and second joist.

There are some issues with using some axial transfer members for transferring loads between two joists. For example, using a plate on top of the joists (e.g., upper chords or seat chords of the joist seats) requires a plate that has a thickness that prevents the ability for an erector to make a connection between the structural decking, the plate, and the joist (e.g., upper chords or the seat chords of the joist seats, or the like) at the same time. For example, erectors would not be able to use fasteners (e.g., screws, bolts, rivets, or other like fasteners) to connect the structural panels to the plate and to the joists (e.g., upper chords or seat chords of the joist seats) because fasteners cannot penetrate through the structural decking, the thick plate, and the joists (e.g., using the portable tools that erectors have at elevated levels within a building). It should be further understood, that erectors would not be able to use welds to weld the structural decking, the plate, and the joists together (e.g., upper chords or seat chords of the joist seats) at a single location. The three components in combination are too thick to effectively weld through all three components. In other examples, other types of connectors cannot be used to connect the structural decking, the plate, and the joists together because other types of connectors cannot penetrate all three components effectively.

Moreover, in other types of designs in which axial transfer members are located below the top of the chords (e.g., upper chords or seat chords of the joist seats, or the like), it may be difficult to make a connection because it is difficult for the erectors to reach the connection locations (e.g., welding location, fastener location, or the like) under the tops of the chords of the joist seats (e.g., under the top chords of adjacent upper chords or seat chords) after the joists are installed.

As such, in these types of designs a first connection of the axial transfer members to the first joist (e.g., the first chord of the first joist seat) and second joist (e.g., the second chord of the second joist seat) is required, and a separate second connection between the decking and the first joist and the second joist or the axial transfer member is required. For example, with respect to the use of a plate on the top of the joist seats, the plate is operatively coupled to the joist (e.g., upper chord or seat chord of the joist seats, or the like) using fasteners, welds, or another connector. Thereafter, the structural decking is operatively coupled to the plate and/or the joist seat adjacent the plate (e.g., connected to the plate and connected to joist where the plate is not located). In another example, with respect to the use of an angle (or other axial transfer member) under a chord (e.g., within the inside surface of the L-shaped chord, or the like), connections are made under the chords, and then the structural panels are connected to the top of the chords of the joists or joist seat.

Alternatively, the axial transfer member described in further detail below, may be referred to as a joist tie (e.g., an axial cold-formed steel member, or the like), which is designed to increase the strength of the tie and reduce the thickness of the joist tie, in order to provide the desired strength and the ability to make connections that operatively couple the decking, the joist tie, and the joist together using a single connector. The joist tie may be strengthened through the use of one or more ribs and/or one or more flanges. Moreover, the one or more ribs may be utilized to reduce the profile of the tie, for example, the one or more ribs may be dimensioned to fit within one or more cavities within the first joist and the second joist (e.g., a first cavity and the second cavity, such as cavities formed by chords of the joists, such as in the joist seats). The shape of the joist tie may be dimensioned in order to allow the joist tie to be placed on the first joist (e.g., upper chord or seat chord of the joists) without having to be attached (or only attached temporarily) during assembly until final assembly of the structural decking. After the components are placed over each other, the connection of the structural decking, the tie, and the joists (e.g., the upper chords and/or the joist seats) can be made at the same time. As will be described herein, the tie may have a single rib or multiple ribs and/or may have various shapes.

It should be understood that due at least in part to the shape of the joist tie (e.g., the ribs and/or flanges), which increases the strength of the joist tie, the thickness of the joist tie may be reduced. Consequently, due to the reduced thickness of the joist tie, the decking panels can be placed directly on top of the tie without the formation of a "bump" in the decking (e.g., which would be present with the use of thicker plates). Furthermore, due to the reduced thickness of the joist tie, the tie and structural decking can be operatively coupled to the joists using a single connection (e.g., in a single multi-ply attachment to the joist by arc seam weld, arc spot weld, fastener, such as a screw, bolt, nut, pin, nail, rivet, or other connection method). It should be understood that there may be multiple connections between the structural decking, the tie, and the joists, but each of the connections may operatively couple all three components. It some embodiments of the invention, the tie may be attached to a joist prior to erection on the support member or during assembly of a panelized decking system (e.g., plurality of joists assembled to each other) before lifting the joist or panelized system onto the building.

Embodiments of the disclosure comprise a structural decking system. The structural decking system comprises one or more support members, a first joist having first opposing ends and at least one first joist seat, the first joist seat comprising a first chord having a first cavity, and a second joist having second opposing ends and at least one second joist seat, the second joist seat comprising a second chord having a second cavity. The first proximal end of the first joist and the second proximal end of the second joist are operatively coupled to a first support member in series. The structural decking system further comprises a tie comprising one or more ribs, and the tie is operatively coupled to the first proximal end of the first joist and the second proximal end of the second joist. A first portion of the one or more ribs of the tie is located within the first cavity of the first chord and a second portion of the one or more ribs of the tie is located within the second cavity of the second chord.

In further accord with embodiments of the of the disclosure, the tie comprises a tie web having a single rib, and one or more tie flanges operatively coupled to the tie web. In other embodiments of the disclosure, the one or more tie flanges comprise a first tie flange operatively coupled to the tie web and a second tie flange operatively coupled to the tie web. In still other embodiments of the disclosure, the one or more tie flanges comprise a third tie flange operatively coupled to the first tie flange, and a fourth tie flange operatively coupled to the second tie flange. In yet other embodiments of the disclosure, the first tie flange and the second tie flange are generally perpendicular with the tie web, and wherein the third tie flange and the fourth tie flange are generally perpendicular with the first tie flange and the second tie flange. In further accord with embodiments of the disclosure, the first tie flange and the second tie flange are substantially perpendicular with the tie web, and wherein the third tie flange and the fourth tie flange are substantially perpendicular with the first tie flange and the second tie flange. In other embodiments of the disclosure, the first tie flange and the second tie flange are perpendicular with the tie web, and wherein the third tie flange and the fourth tie flange are perpendicular with the first tie flange and the second tie flange.

In still other embodiments of the disclosure, the one or more ribs comprise a single rib extending a length of the tie, wherein the first portion of the single rib of the tie is located within the first cavity of the first chord and the second portion of the single rib of the tie is located within the second cavity of the second chord.

In yet other embodiments of the disclosure, the one or more ribs comprise two or more ribs extending over at least a portion of a length of the tie. In further accord with embodiments of the disclosure, the first portion of the two or more ribs comprises a first rib that is located within the first cavity of the first chord, and wherein the second portion of the two or more ribs comprises a second rib that is located within the second cavity of the second chord.

In other embodiments of the disclosure, the one or more ribs have a height that is greater than a tie web thickness of a tie web. In still other embodiments of the disclosure, the height is greater than a chord thickness of the first chord and the second chord. In other embodiments of the disclosure, a tie web thickness of a tie web is less than or equal to 0.25 inches.

In further accord with embodiments of the disclosure, the system further comprises decking operatively coupled to the tie and the first joist or second joist. The decking is operatively coupled to the tie and the first proximal end of the first joist or the second proximal end of the second joist through one or more connectors, wherein a single connector operatively couples the decking, the tie, and the first proximal end of the first joist or the second proximal end of the second joist.

In still other embodiments of the disclosure, the first cavity of the first chord or the second cavity of the second chord comprise two angles operatively coupled to each other, wherein the two angles form the first cavity or the second cavity.

In yet other embodiments of the disclosure, the first chord is a first upper chord or a first seat chord, and wherein the second chord is a second upper chord or a second seat chord.

Embodiments of the disclosure comprise a joist tie. The joist tie comprises a tie web and one or more ribs in the tie web. The tie is configured to be operatively coupled to a first proximal end of a first joist and a second proximal end of a second joist of a decking system. The first portion of the one or more ribs is configured to be operatively coupled within a first cavity of a first chord of the first joist and a second portion of the one or more ribs is configured to be operatively coupled within a second cavity of a second chord of the second joist.

In further accord with embodiments of the disclosure, the joist tie comprises one or more tie flanges operatively coupled to the tie web, and wherein the one or more tie flanges comprise a first tie flange operatively coupled to the tie web and a second tie flange operatively coupled to the tie web. In other embodiments of the disclosure, the one or more tie flanges comprise a third tie flange operatively coupled to the first tie flange, and a fourth tie flange operatively coupled to the second tie flange.

In still other embodiments of the disclosure, the one or more ribs comprises a single rib extending a length of the tie, wherein the first portion of the single rib of the tie is located within the first cavity and the second portion of the single rib of the tie is located within the second cavity. In yet other embodiments of the disclosure, the one or more ribs comprise two or more ribs extending over at least a portion of a length of the tie.

Embodiments of the disclosure comprise a method of assembling a structural decking system. The method comprises assembling a first joist having first opposing ends and at least a first joist seat to one or more support members, wherein the first joist seat comprises a first chord having a first cavity. The method further comprises assembling a second joist having second opposing ends and at least a second joist seat to the one or more support members, wherein the second joist seat comprises a second chord having a second cavity. The method also comprises assembling a tie comprising one or more ribs to a first proximal end of the first joist and a second proximal end of the second joist, wherein the first proximal end of the first joist is operatively coupled to the second proximal end of the second joist in series. As such, a first portion of the one or more ribs of the tie is located within the first cavity of the first chord and a second portion of the one or more ribs of the tie is located within the second cavity of the second chord.

To the accomplishment of the foregoing and the related ends, the one or more embodiments of the invention comprise the features hereinafter fully described and particularly pointed out in the claims. The following description and the annexed drawings set forth certain illustrative features of the one or more embodiments. These features are indicative, however, of but a few of the various ways in which the principles of various embodiments may be employed, and this description is intended to include all such embodiments and their equivalents.

BRIEF DESCRIPTION OF DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Embodiments of the present invention now may be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure may satisfy applicable legal requirements. Like numbers refer to like elements throughout.

Figure 1:
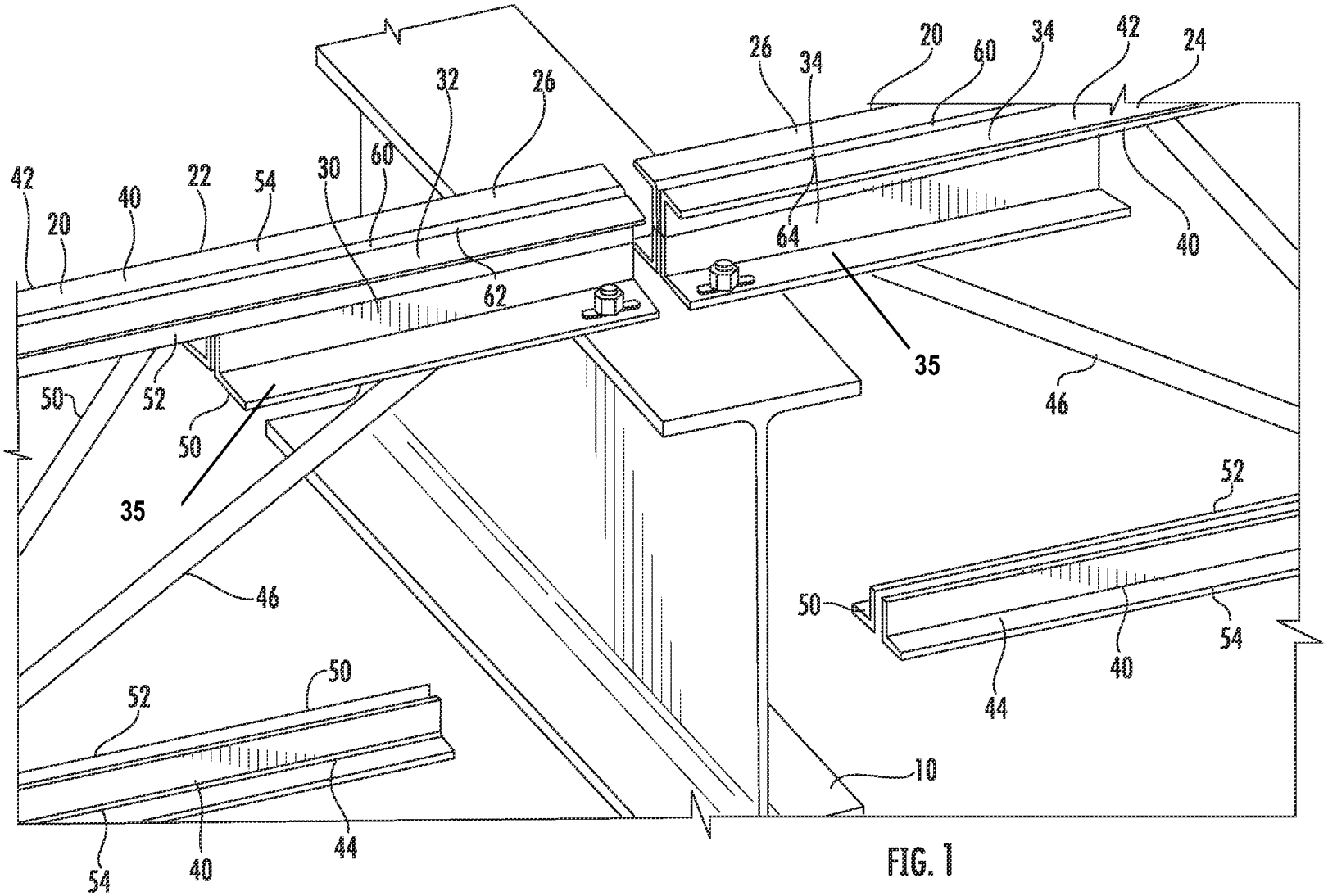
FIG. 1 illustrates a perspective view of a structural decking system before the structural decking is installed, in accordance with embodiments of the present invention.
Figure 12:
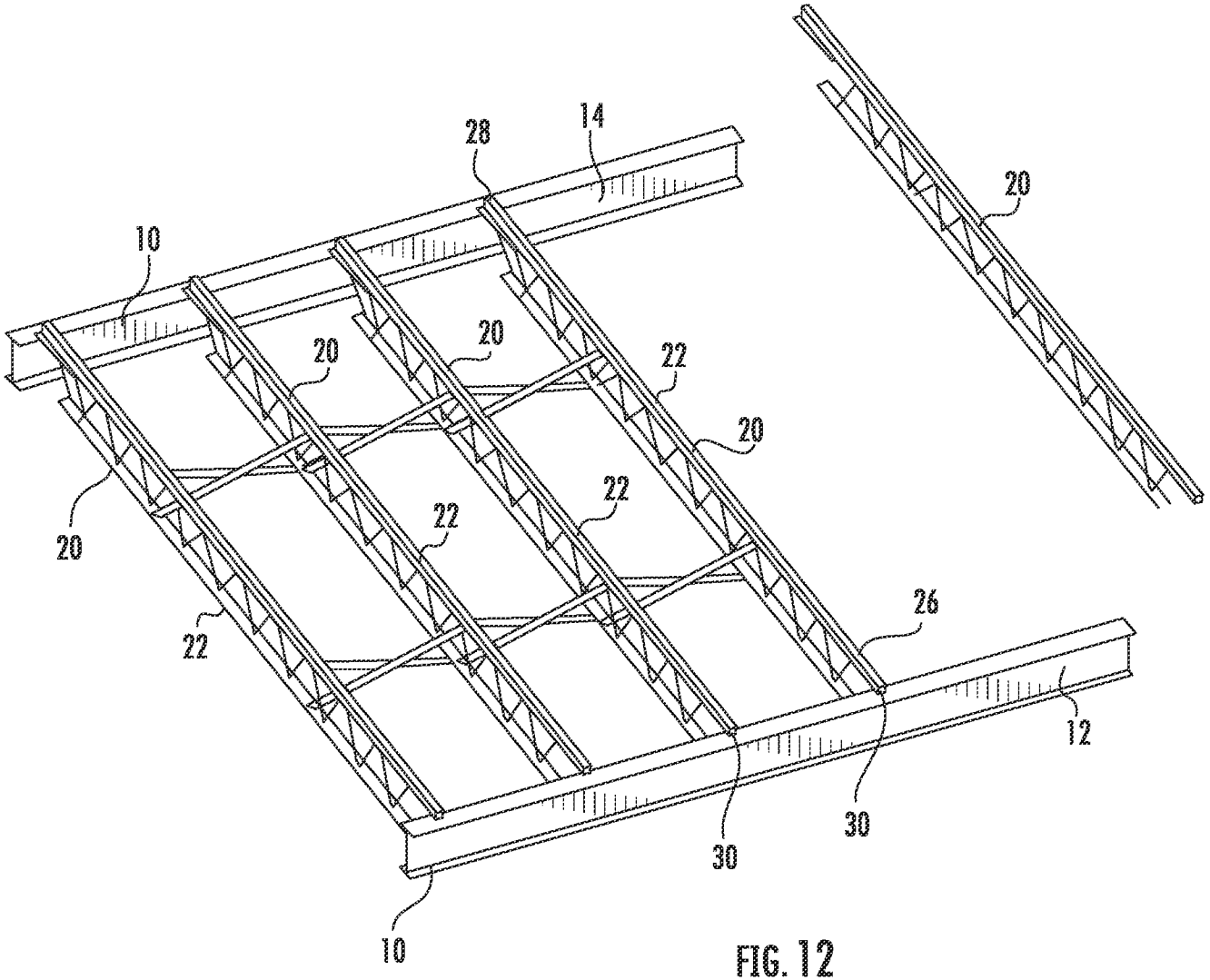
FIG. 12 illustrates a perspective view of a portion of a structural decking system being assembled, in accordance with embodiments of the present disclosure.
Figure 13:
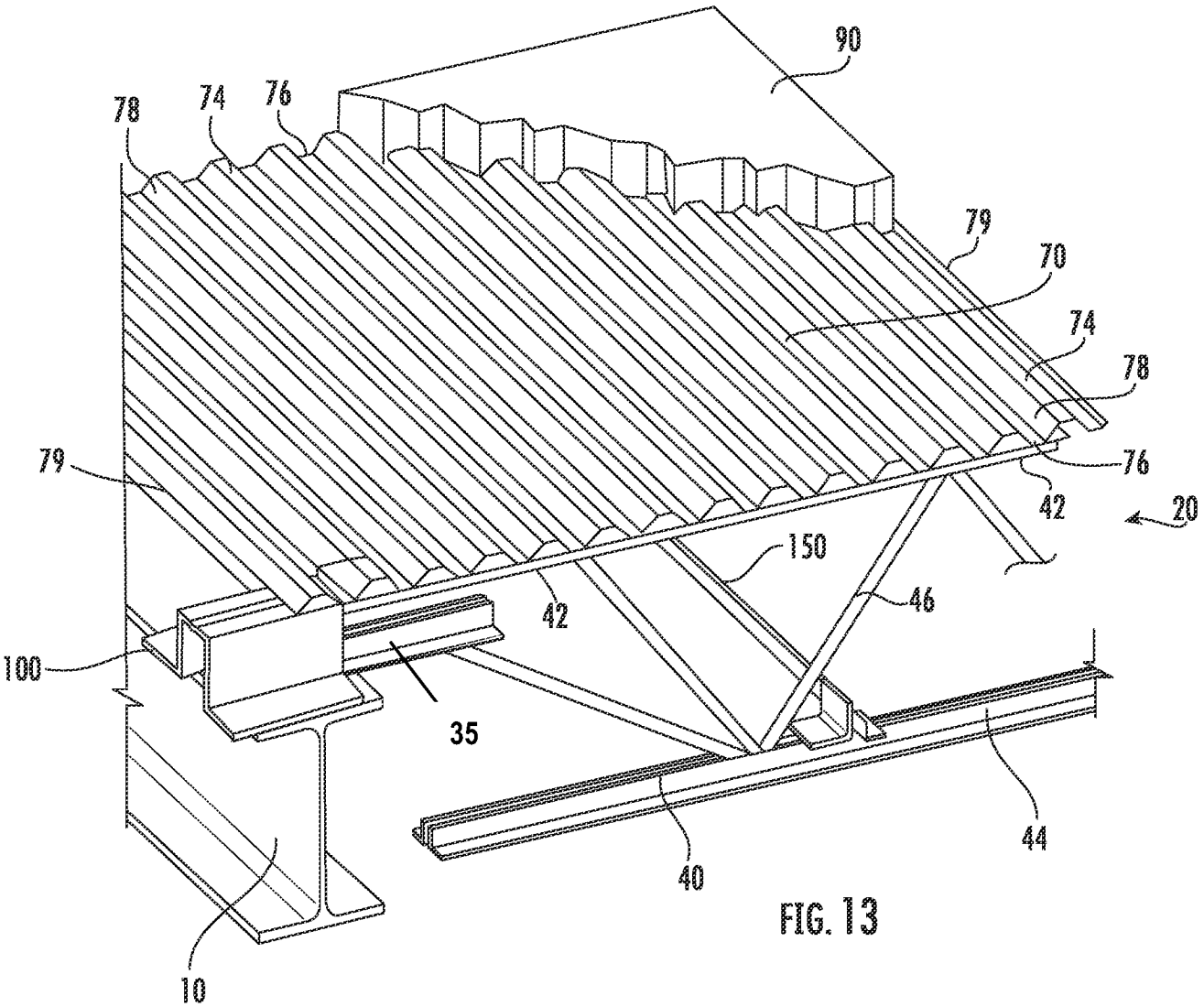
FIG. 13 illustrates a perspective view of an assembled structural decking system with a portion of the concrete removed, in accordance with embodiments of the present disclosure.

The present invention relates to a joist tie (otherwise described as a stiffener, a joist element, or generally as an axial transfer member) that is operatively coupled to two adjacent joists located in series on a first support member 12. FIG. 1 illustrates an assembled structural decking system 1 with the tie 100, structural decking 70, and concrete 90 removed. The structural decking system 1 comprises one or more support members 10 (e.g., beams, girders, joists, or other like support members) upon which two or more joists 20 are operatively coupled, such as a first joist 22 and a second joist 24. Each joist may have a proximal end 26 and a distal end 28 (illustrated in FIG. 12). A joist seat 30 may be located on one or more of the ends of the joists 20, such as a first joist seat 32 on the first joist 22 and a second joist seat 34 on the second joist 24. Each joist 20 may further comprise multiple chords 40, such as an upper chord 42 and a lower chord 44, which are operatively coupled through the use of joist webs 46. It should be understood that in some embodiments the joist seats 30 may comprises a portion of the upper chord 42 and a seat chord 35, such as a lower seat chord. In some embodiments the upper chord 42 may be operatively coupled directly the seat chord 35 (as illustrated in FIG. 1); however, in other embodiments the upper chord 42 may be spaced apart from the seat chord 35 (as illustrated in FIG. 13) and/or coupled through a joist web 46. In other embodiments it should be understood that the joist seat 30 may comprise of two or more seat chords 35, such as a lower seat chord and an upper seat chord. The upper seat chord and lower seat chord may look like the joist seat 30 illustrated in FIG. 1, but may be separate from the upper chord 42, such that the upper chord 42 is located adjacent, above, or below the top of the joist seat 30. It should be understood that any number of different joist seats 30 may be utilized herein.

Each of the chords 40 (e.g., upper chord, lower chord, and/or one or more seat chords) of the joists 20 may comprise one or more chord members, such as angle members 50. For example, a chord 40 may comprise of a first angle member 52 and a second angle member 54 operatively coupled to each other through one or more spacers (not illustrated) and/or the joist webs 46. In some embodiments, joist webs 46 may comprise angle members, rods, rebar, or other like members that are operatively coupled between a first angle member 52 and second angle member 54 of each chord 40 (e.g., upper chord 42, lower chord 44, one or more seat chords 35, or the like). The angle members 52, 54 may comprise a suitable cross-section, such as a substantially "C" shape, "L" shape, "V" shape, "U" shape, and/or other like shape. In the embodiments illustrated in Figures, each of the angle members 52, 54 of the joists comprise an "L" shape. As such, the angle members 52 and 54 are operatively coupled to each other (e.g., comprising of two "L" shaped angles, or the like), as will be described in further detail herein.

Regardless of the type members used to form the chords 40, it should be understood that the chords 40 may comprise one or more cavities 60, such as a first cavity 62 of a first joist 22 and a second cavity 64 of a second joist 24. It should be understood, that the cavities 60 may be formed from the space created by the one or more members, such as a first angle member 52 and a second angle member 54. As will be discussed in further detail later herein, the cavities 60 may be utilized to secure one or more ribs 120 of the tie 100 before the structural decking 70 is operatively coupled to the joists 20.

As described above, the joist seats 30 (also described as joist shoes), may be formed from one or more members. For example, in one embodiment, the joist seat 30 comprises a portion of a first angle member 52 and a second angle member 54. The joist seat 30 may also comprise one or more apertures 36 (e.g., circular apertures, square apertures, slotted apertures, or other like apertures of different shapes, such as oval, rectangular, or the like) on a portion of the joist seat 30 (e.g., in the angled member of the joist seat 30). The joist seats 30 may be operatively coupled to the support members 10 through a weld along a toe 38 (e.g., an edge of the angle member 52, 54) and/or within one or more apertures 36, and/or through a fastener (e.g., stud, anchor, or the like) extending from the support member 20 and/or inserted into the support member 20, or other like connection. As previously discussed, it should be understood that in some embodiments the joist seat 30 may be separate from the upper chord 42 of the joist 20, such that the joist seat 30 may comprise its own upper seat chord portion (e.g., two angles 52, 54 back to back) operatively coupled to a lower seat chord portion (e.g., two angles 52, 54 back to back). Alternatively, the joist seat 30 may comprise a portion of the upper chord 42 operatively coupled to a lower seat chord portion (e.g., two angles 52, 54 back to back).

Figure 2A:
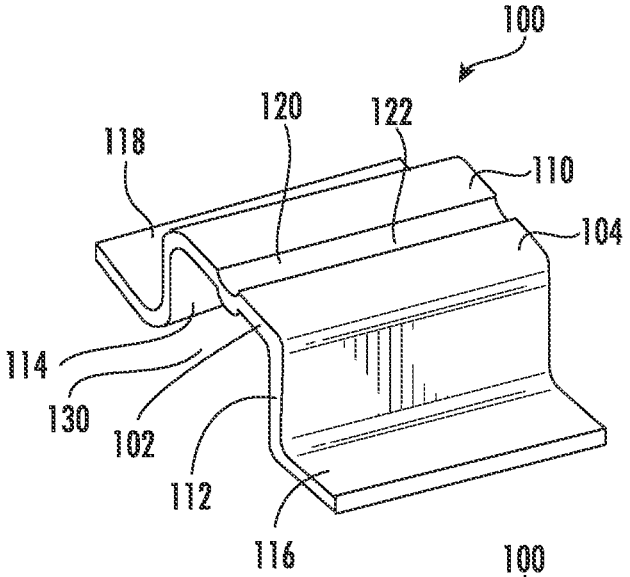
FIG. 2A illustrates a perspective view of a joist tie, in accordance with embodiments of the present disclosure.
Figure 2B:
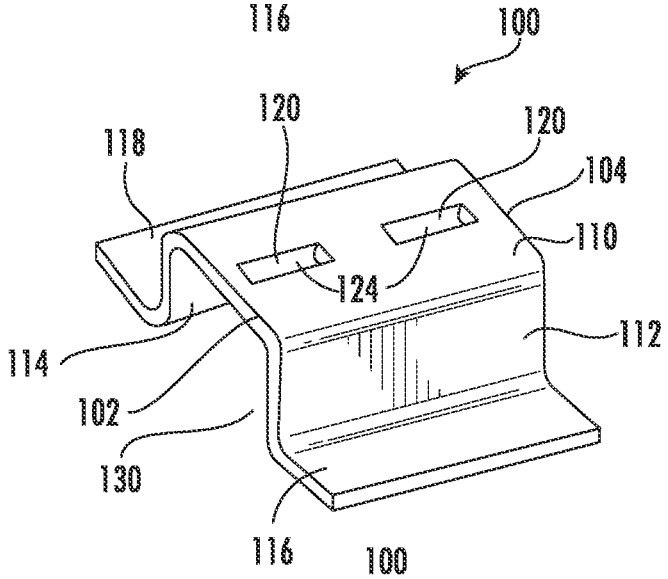
FIG. 2B illustrates a perspective view of a joist tie, in accordance with embodiments of the present disclosure.
Figure 2C:
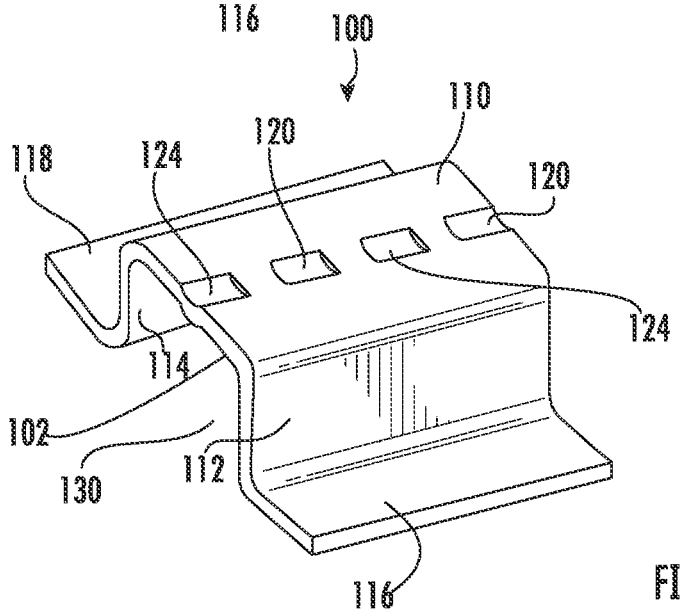
FIG. 2C illustrates a perspective view of a joist tie, in accordance with embodiments of the present disclosure.

FIGS. 2A, 2B, and 2C illustrate embodiments of the joist tie 100. As will be described in further detail herein, the joist tie 100 may comprise a first tie end 102 and a second tie end 104. The joist tie 100 may comprise a tie web 110 and one or more tie flanges. The one or more tie flanges may comprise a first tie flange 112 and a second tie flange 114 that are operatively coupled the tie web 110. Moreover, a third tie flange 116 may be operatively coupled to the first tie flange 112, while a fourth tie flange 118 may be operatively coupled to the second tie flange 114. It should be understood that in some embodiments the first tie flange 112 and second tie flange 114 may be perpendicular, substantially perpendicular, and/or generally perpendicular to the tie web 110, while the third tie flange 116 and the fourth tie flange 118 may be perpendicular, substantially perpendicular, and/or generally perpendicular to the first tie flange 112 and the second tie flange 114, and parallel, substantially parallel, and/or generally parallel to the tie web 110. It should be understood that perpendicular may mean that the components are oriented about 90 degrees from each other, while substantially perpendicular may mean that the components are oriented between the range of about 75 to about 105 degrees, while generally perpendicular may mean that the components are orientated between about 45 to about 135 degrees with respect to each other. It should be understood that parallel may mean that the components are oriented in the same direction about 0 degrees with respect to each other, while substantially parallel may mean that the components are oriented in the same direction between the range of about −15 to about +15, while generally parallel may mean that the components are orientated between about −45 to about 45 degrees with respect to each other. It should be understood that these ranges described herein may vary by +/−1, 2, 3, 4, 5, 6, 7, 8, 9, 10 degrees.

The tie web 110 and/or one or more of the tie flanges may comprise one or more tie ribs 120. As illustrated in FIG. 2A the one or more tie ribs 120 may comprise a single rib 122 that extends along at least a portion of the length of the tie 100 from a first tie end 102 to a second tie end 104. In some embodiments, the rib 122 may extend the length of the tie 100 from a first tie end 102 to a second tie end 104. In other embodiments the tie 100 may extend from one end (e.g., a first tie end 102 or a second tie end 104 into a portion of the tie web 110, such as 5, 10, 20, 30, 40, 50, 60, 70, 80, 90, 95, 99, or other like percent of the length of the tie 100. In still other embodiments, the tie 100 may extend from one location within the tie web 110 to another location within the tie web 110. For example, the rib 122 may not extend to the ends 102, 104 of the joist tie 100, but instead may extend a length that is 5, 10, 20, 30, 40, 50, 60, 70, 80, 90, 95, 99, or other like percent of the joist tie 100. Alternatively, the joist tie 100 may comprise a plurality of tie ribs 124 (e.g., two or more), as illustrated in some embodiments in FIGS. 2B and 2C. It should be understood that any number of tie ribs may be utilized, such as 2, 3, 4, 5, 6, 7, 8, 9, 10, 15, 20, or the like, or any range between, overlapping, or outside of these values.

Moreover, like the single joist tie 120 described above, each of the one or tie ribs 120 may extend from the ends 102, 104 of the tie 100, within a portion of the tie web 110 (as illustrated in FIG. 2B), and/or a combination thereof (as illustrated in FIG. 2C). It should be understood that different shapes of the joist tie 100, as well as the location size and shape of the ribs 120, may be utilized, as will be described for some embodiments in further detail herein.

Figure 3:
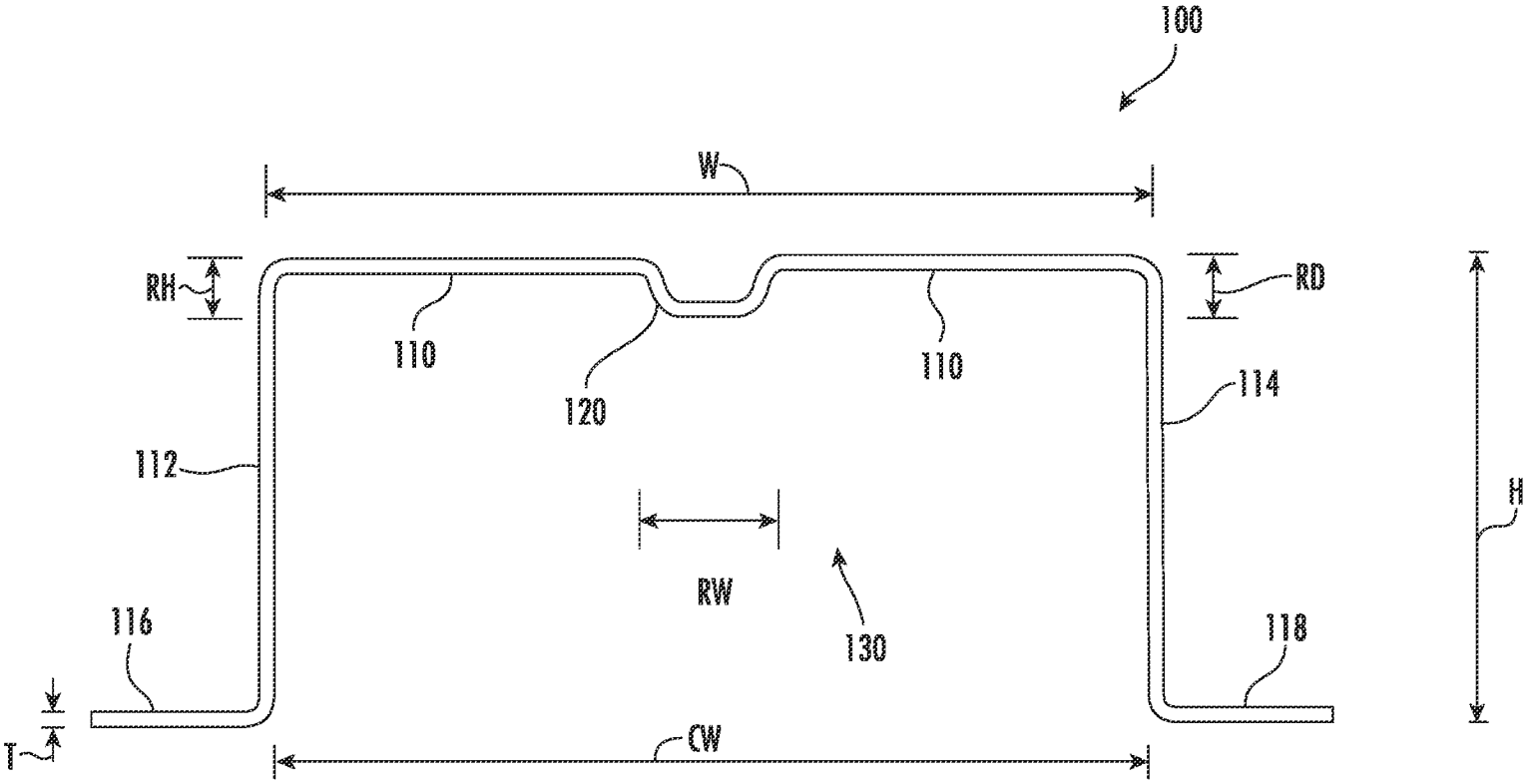
FIG. 3 illustrates an end view of a joist tie, in accordance with embodiments of the present disclosure.
Figure 4:
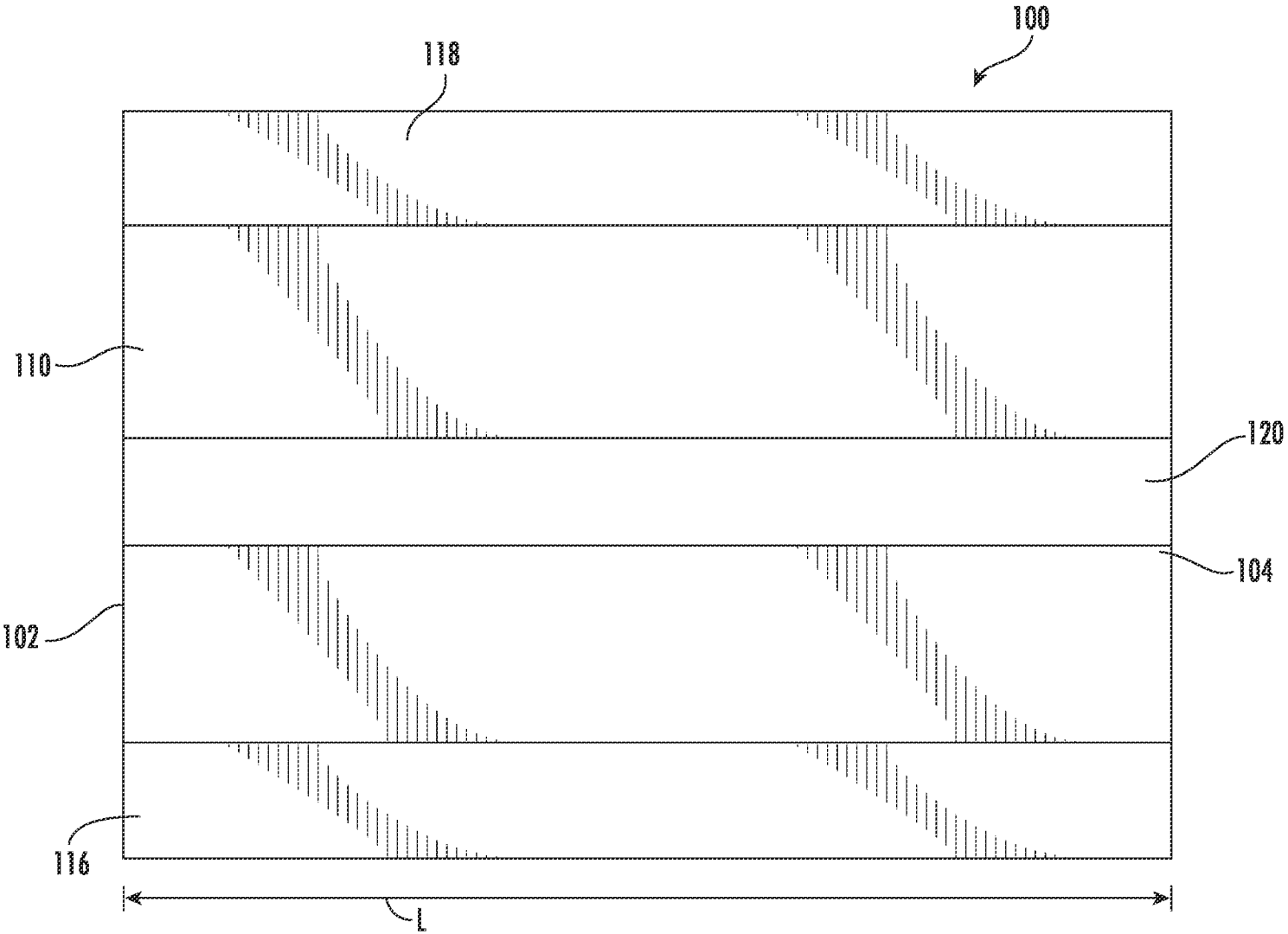
FIG. 4 illustrates a top view of the joist tie of FIG. 3, in accordance with embodiments of the present disclosure.
Figure 5:
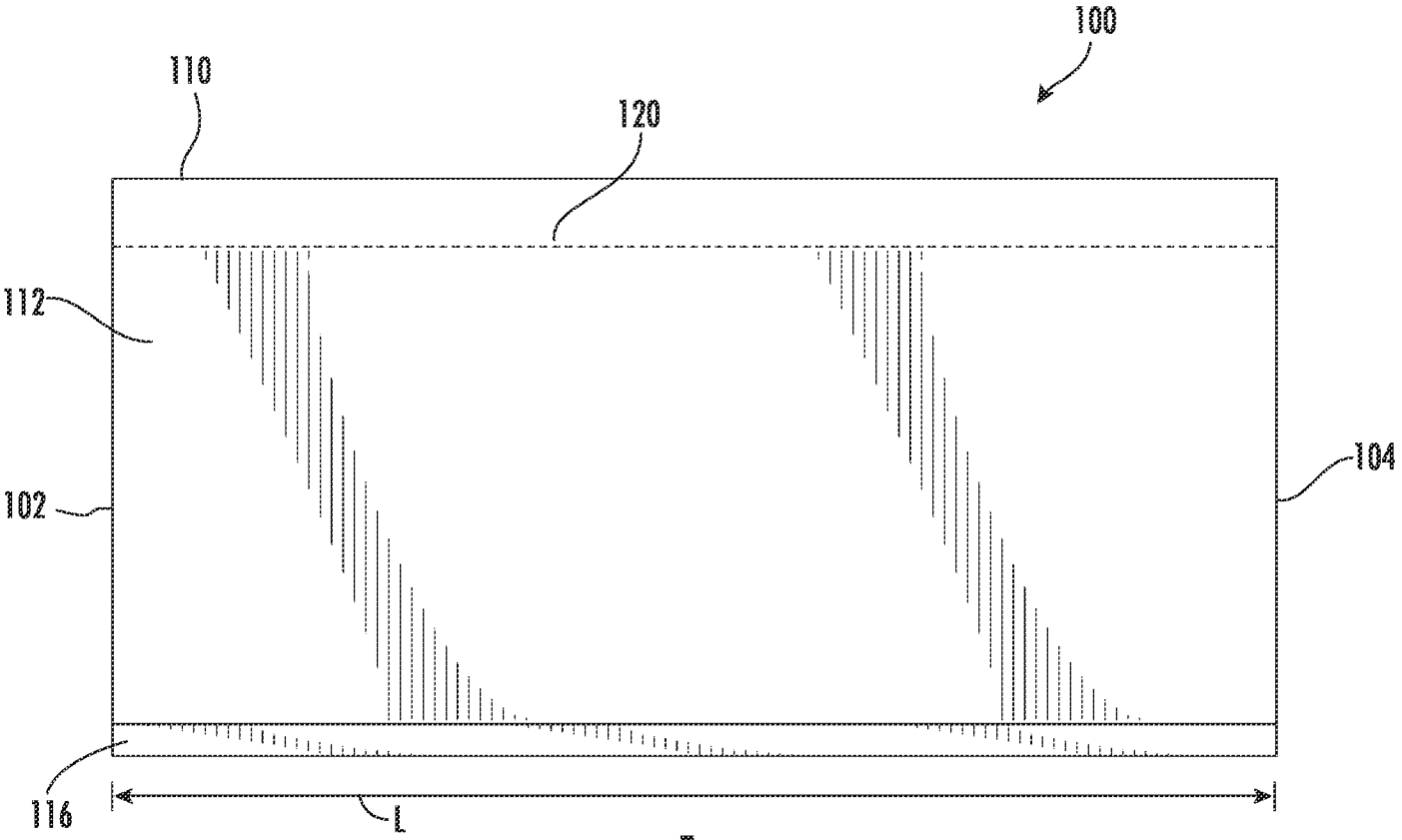
FIG. 5 illustrates a side view of the joist tie of FIG. 3, in accordance with embodiments of the present disclosure.

FIGS. 3-5 illustrate an end view, a top view, and a side view of the tie 100 of FIG. 2A in further detail. As illustrated by FIGS. 3-5, the tie 100 may be dimensioned such that the one or more ribs 120 are positioned in the cavities 60 of the joists 20, and the tie cavity 130 (e.g., formed from the tie web 110, the first flange 112, the second flange 114, and/or any additional flanges) accepts a portion of the joist seats 30 and/or the joists 20 (e.g., a portion of the first joist 22 and the second joist 24). For example, the tie cavity 130 may accept a portion of the proximal ends 26 of the first joist 22 and/or the second joist 24, and/or a portion of the first joist seat 32 and/or the second joist seat 34. As such, the width of the tie cavity 130 (CW) may be slightly larger than the width of the joist 20 (e.g., joist seat 30, such the upper chord 42 and/or the seat chords 35). Moreover, the height (H) of the tie 100 may be slightly taller than the height of the joist seat 30 (e.g., the upper chord 42 and/or the seat chords 35—each alone, in combination with each other when directly coupled, or in combination with each other when spaced apart and coupled through the use of joist webs 46 depending on how the joist seats 30 are configured). The length (L) of the tie 100 may be the same length as the width of the support member 10; however, the length (L) of the tie 100 may be any length as long as the tie 100 is able to extend past at least a portion of a first joist 22 and a second joist 24 (e.g., at the proximal ends 26 of the joists 22, 24—that is, a portion of the joist seats 30, or the like). It should be further understood that the width (W) of the tie 100 may extend past the width of the joist seats 30 (e.g., the upper chord 42 and/or the seat chord 35, or the like). That is, one or more of the flanges (e.g., the third flange 116 and the fourth flange 118) may extend past the width of the joist seat 30 in order to provide additional support for tying a first joist 22 to a second joist 24. In some embodiments of the invention, one or more of the flanges may be operatively coupled to the support member 10 through the use of a connector.

The tie 100 may be sized using any dimension. However, it should be understood that in some embodiments of the invention the height (H) of the tie may range between 1, 1.5, 2, 2.25, 2.5, 2.75, 3, 3.5, 4, 4.5, 5, or the like inches; the width of the tie cavity (CW) may range between 3, 3.5, 4, 4.5, 5, 5.5, 6, 6.25, 6.50, 6.75, 7, 7.5, 8, 8.5, 9, 9.5, 10, or the like inches; the width (W) of the tie ranges between 4, 4.5, 5, 5.5, 6, 6.5, 7, 7.25, 7.5, 7.75, 8, 8.25, 8.5, 8.75, 9, 9.5, 10, 10.5, 11, 11.5, 12, or the like inches; and/or the length of the tie (L) ranges between 4, 5, 6, 7, 8, 9, 10, 11, 12, 13, 14, 15, 16, 17, 18, 19, 20, 21, 22, 23, 24, 26, 28, 30, 32, 34, 36, 40, 44, 48, or the like inches. Moreover, the one or more ribs 120 may comprise a rib height (RH) that ranges between 0.1, 0.125, 0.15, 0.175, 0.2, 0.225, 0.25, 0.275, 0.3, 0.325, 0.35, 0.375, 0.4, 0.5, 0.6, 0.7, 0.8, 0.9, 1, 1.5, 2, 2.5, or the like inches; a rib width (RB) that ranges between 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.2, 1.4, 1.6, 1.8, 2.0, 2.5, or the like inches; and/or a rib length (RL) that ranges between 0.1, 0.15, 0.2, 0.25, 0.3, 0.35, 0.4, 0.45, 0.5, 0.55, 0.6, 0.65, 0.7, 0.75, 0.8, 0.85, 0.9, 0.95, 1, 1.2, 1.4, 1.6, 1.8, 2.0, 2.5, 3.0, 3.5, 4, 5, 6, 7, 8, 9, 10, 11, 12, 13, 14, 15, 16, 17, 18, 19, 20, 21, 22, 23, 24, 26, 28, 30, 32, 34, 36, 40, 44, 48, or the like inches for one or more of the ribs (alone or in combination). All of the ranges may be inclusive and/or exclusive, and/or the values may vary by +/−1, 3, 5, 7, 10, 15, 20, 25, 30, 35, 40, 45, 50, 55, 60, 75, 80, 85, 90, or other like percent.

Figure 6:
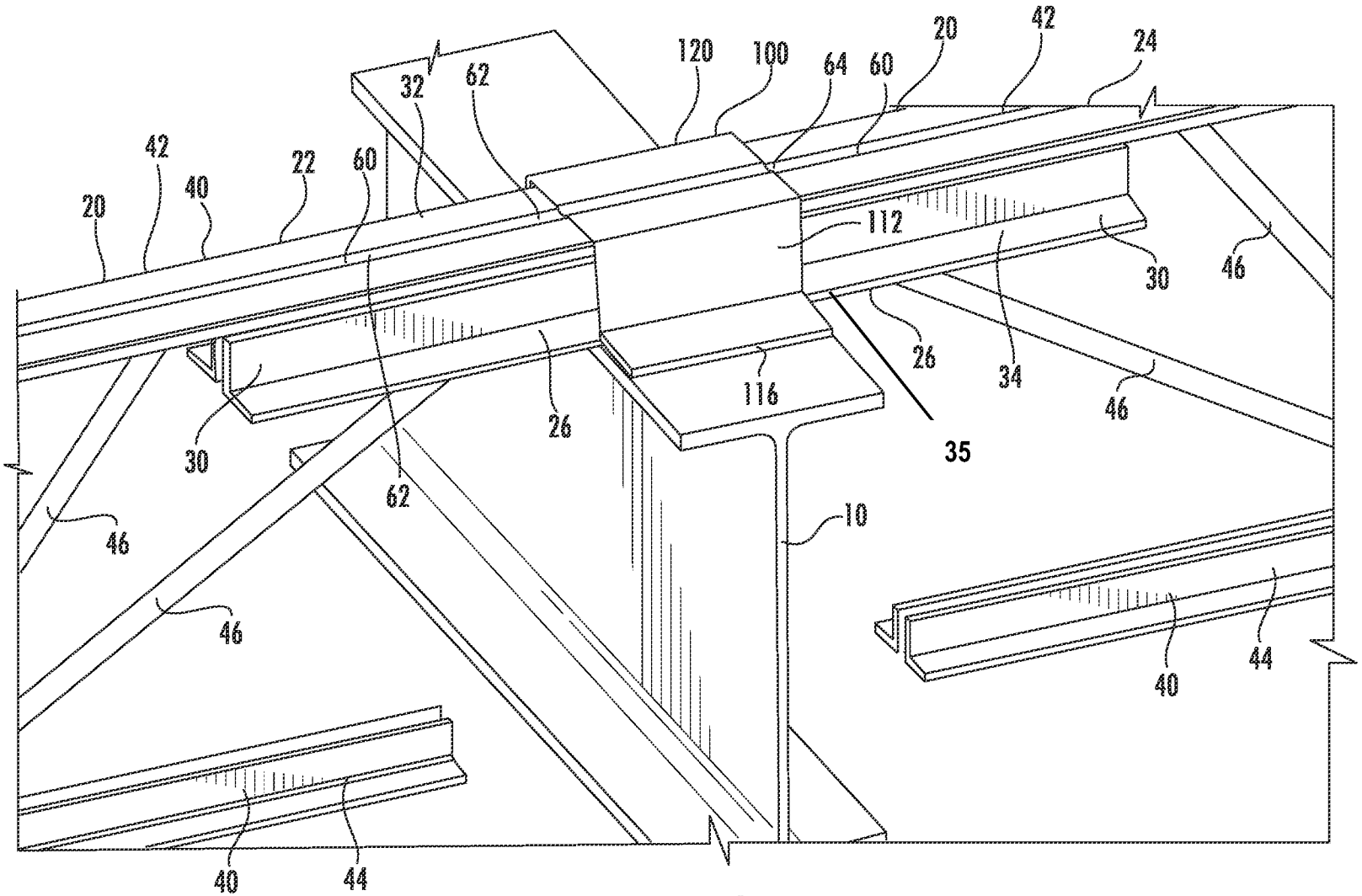
FIG. 6 illustrates a perspective view of a structural decking system with a joist tie, in accordance with embodiments of the present disclosure.
Figure 7:
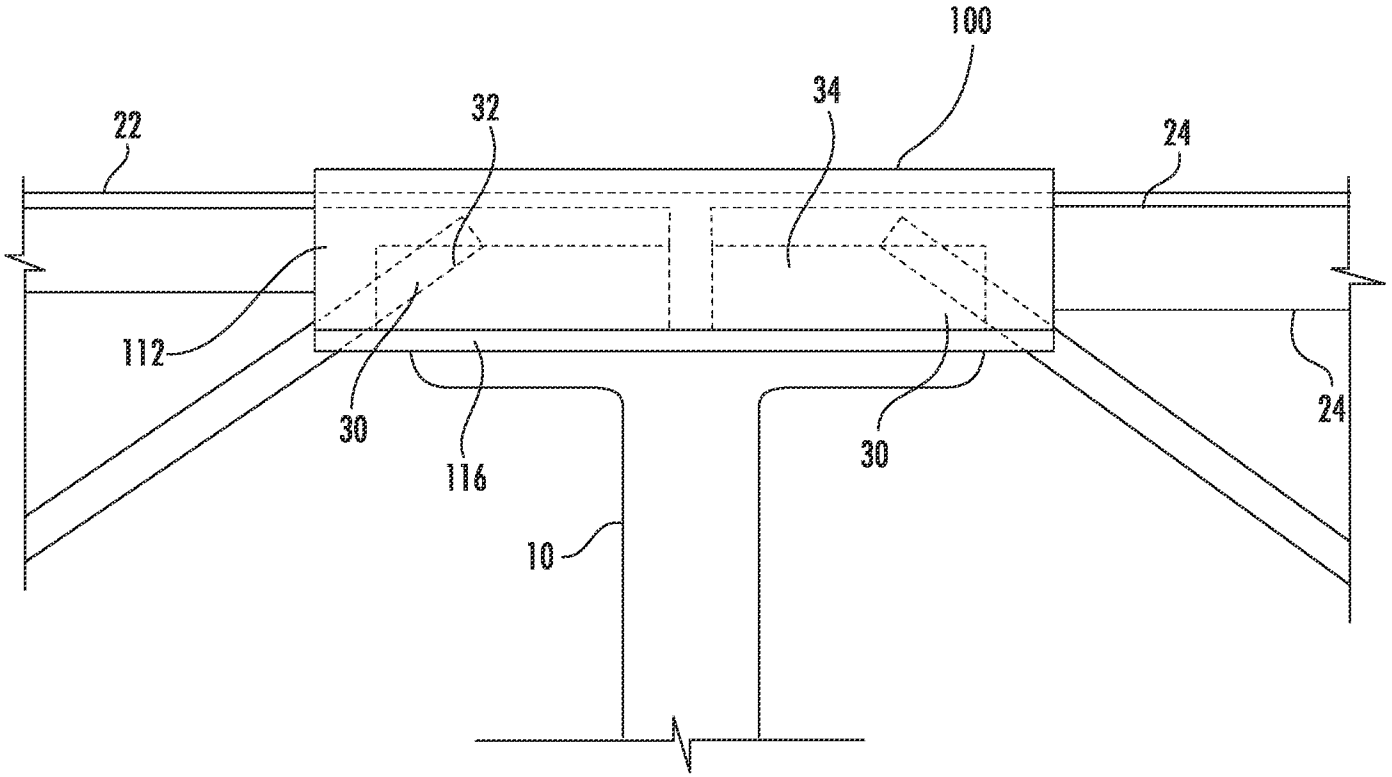
FIG. 7 illustrates a side cross-sectional view of a structural decking system with a joist tie, in accordance with embodiments of the present disclosure.
Figure 8:
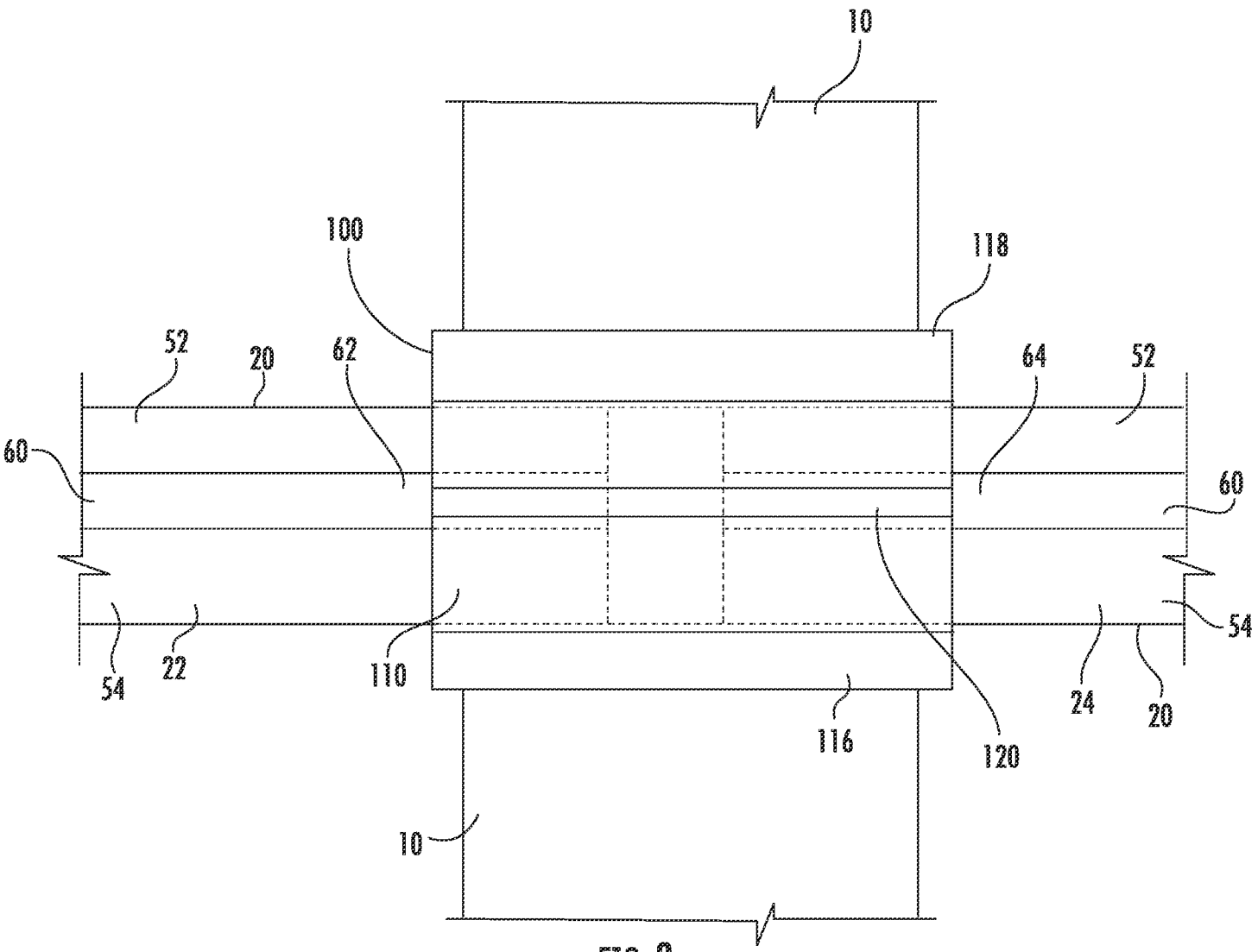
FIG. 8 illustrates a top view of a structural decking system with a joist tie, in accordance with embodiments of the present disclosure.

FIGS. 6-8 illustrate embodiments of the joist tie 100 installed on the first joist 22 and the second joist 24 of the decking system 1, which was previously discussed with respect to FIG. 1. As illustrated in FIG. 6, when the tie 100 is assembled, the tie 110 may be placed over the first joist 22 and the second joist 24 such that the one or more ribs 120 of the tie 100 are located in the cavities 60 of the first joist 22 and the second joist 24 (e.g., in the first joist cavity 62 and the second joist cavity 64). As illustrated in FIG. 6, as previously described above, it should be understood that the tie web 110 may be the same or similar width as the joist seats 30, while the first tie flange 112 and second tie flange 114 may have the same or similar height as the joist seat 30. In this way, the joist tie 100 may be sized to fit over the joist seats 30 of the adjacent joists 20. It should be further understood that the third tie flange 114 and the fourth tie flange 116 may be sized to rest on the one or more support members 10, as illustrated in FIG. 6.

It should be understood that while the joist tie 100 is illustrated as having the same length along the tie web 110 and the one or more flanges, the tie web 100 and the one or more flanges may have different lengths with respect to each other (or with respect to individual flanges). For example, the tie web 100 may be longer or shorter than the one or more flanges. Alternatively, the first tie flange 112, the second tie flange 114, the third tie flange 116, and/or the fourth tie flange 118 (or other flanges) may be longer or shorter than each other, in order to facilitate assembly with the joists 20 and/or the one or more support members 10.

Regardless of the specific size and shape of the joist ties 100, the joist ties 100 are configured to be placed over the joists 20 of the decking system without having to secure the ties 10 to the joists 20 with a connection before the decking is installed over the joists 20 and the tie 100. That is, the one or more ribs 120 may fit within the cavities 60 of the joists 20, and the tie web 110 and flanges crate a tie cavity 130 that is sized to mate with the joists 20 (e.g., the joist seats 30), in a way that limits movement of the joist tie 100 to allow for subsequent assembly of the structural decking 70 without having to make a separate connection between the joist tie 100 and the joists 20 (e.g., first joist seat 32 and second joists seat 34).

Figure 9A:
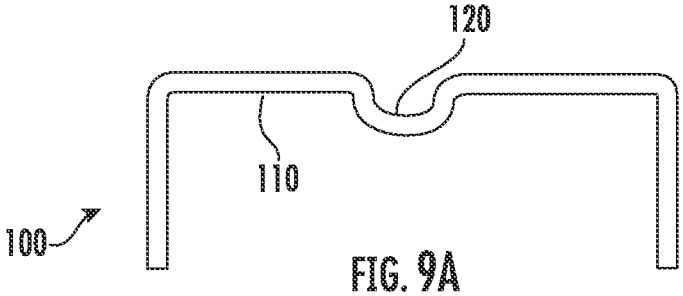
FIG. 9A illustrates an end view of a joist tie, in accordance with embodiments of the present disclosure.
Figure 9B:
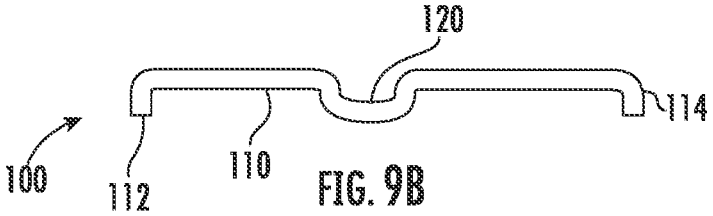
FIG. 9B illustrates an end view of a joist tie, in accordance with embodiments of the present disclosure.
Figure 9C:
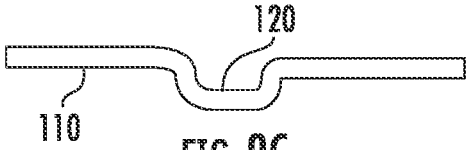
FIG. 9C illustrates an end view of a joist tie, in accordance with embodiments of the present disclosure.
Figure 9D:
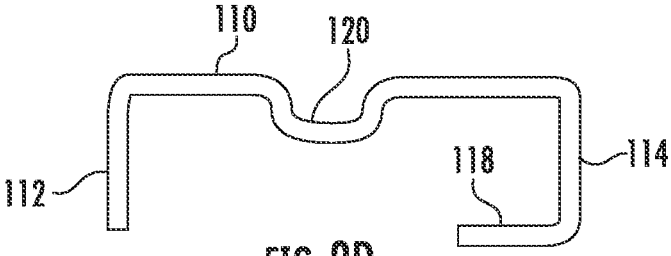
FIG. 9D illustrates an end view of a joist tie, in accordance with embodiments of the present disclosure.
Figure 9E:
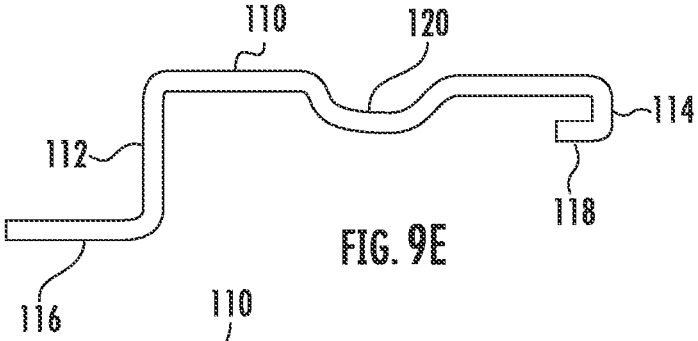
FIG. 9E illustrates an end view of a joist tie, in accordance with embodiments of the present disclosure.
Figure 9F:
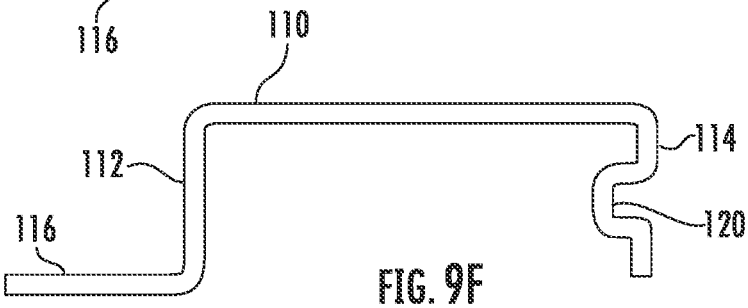
FIG. 9F illustrates an end view of a joist tie, in accordance with embodiments of the present disclosure.

FIGS. 9A-9F illustrate alternate embodiments of the tie 100. For example, FIG. 9A illustrates a tie 100 similar to the ties 100 illustrated in FIGS. 2A-2B, except the tie 100 of FIG. 9A illustrates that it omits the third tie flange 116 and fourth tie flange 118. Alternatively, FIG. 9B illustrates the tie 100 of FIG. 9A except it omits most of the first tie flange 112 and second tie flange 114 except for small flanges that would allow the tie 100 to wrap around edges of the joists 20, such as the joists seats 30. In other examples, FIG. 9C illustrates the ties of FIGS. 9A and 9B except the tie 100 omits the first tie flange 112 and the second tie flange 114 completely. Alternatively, FIG. 9D illustrates different embodiments of the tie 100, in which the third flange 116 and/or the fourth flange 118 are turned inwardly toward the tie cavity 130 instead of outwardly away from the tie cavity. FIG. 9E illustrates that in some embodiments the third flange 116 and/or the fourth flange 118 are turned inwardly toward the tie cavity 130 near an edge of the tie web 110, such that the tie 100 may comprise a hook that is configured to hook around at least a portion of the joists 20, such as the joist seats 30 (e.g., a portion of an angle member 52, 54). FIG. 9F illustrates another embodiment of the tie 100 in which the rib 120 is located on the side of the tie 100 instead of in the tie web 110, such as for example in the first tie flange 112 and/or the second tie flange 114. It should be understood that two or more of the features of the embodiments of the ties 100 described herein may be combined in order to provide the benefits of the tie 100 described herein (e.g., improved load transfer between joists 20, elimination of connector locations, single connection between the decking, tie 100, and/or the joists 20, elimination of deformation of the decking at the location of the ends of the joists 20, and/or elimination of difficult connections—welding—inside the angles of the joists 20—joist seats 30).

Figure 10:
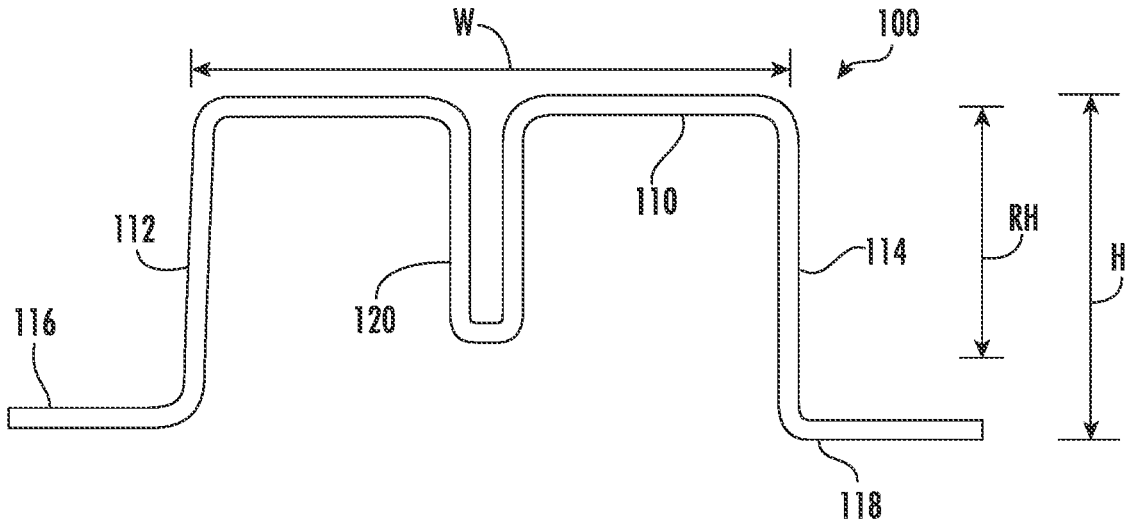
FIG. 10 illustrates end view of a joist tie, in accordance with embodiments of the present disclosure.

Moreover, FIG. 10 illustrates an alternate embodiment of the tie 100. For example, FIG. 10 illustrates a tie 100 similar to the ties 100 illustrated in FIGS. 2A-2C, except the one or more ribs 120 includes a deep ridge. In some embodiments the ridge height (RH) may extend a height that is greater than or equal to a quarter, third, half, three-quarters, or the like the height of the tie 100. In some embodiments the ridge height (RH) may be larger than the height of the upper portion of the joist seat 30 (e.g., the upper chord 42, or the like). The larger ridge height (RH) may provide additional structural support, a more secure tie 100 within the cavities 60 of the joists 20 (e.g., first joist 22 and/or second joist 24), or the like.

Figure 11:
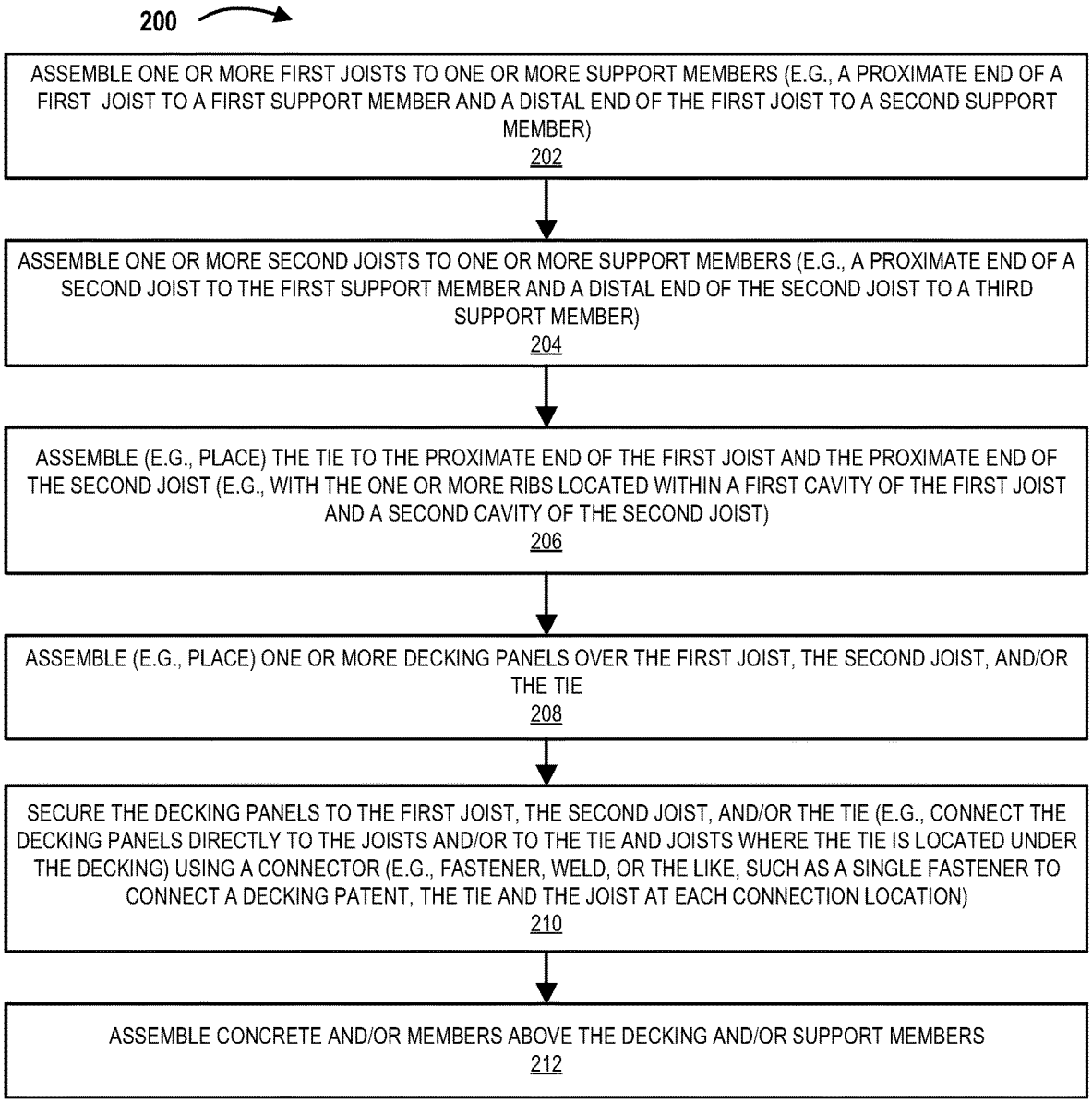
FIG. 11 illustrates a process flow for assembly of the structural decking system, in accordance with embodiments of the present disclosure.
Figure 14:
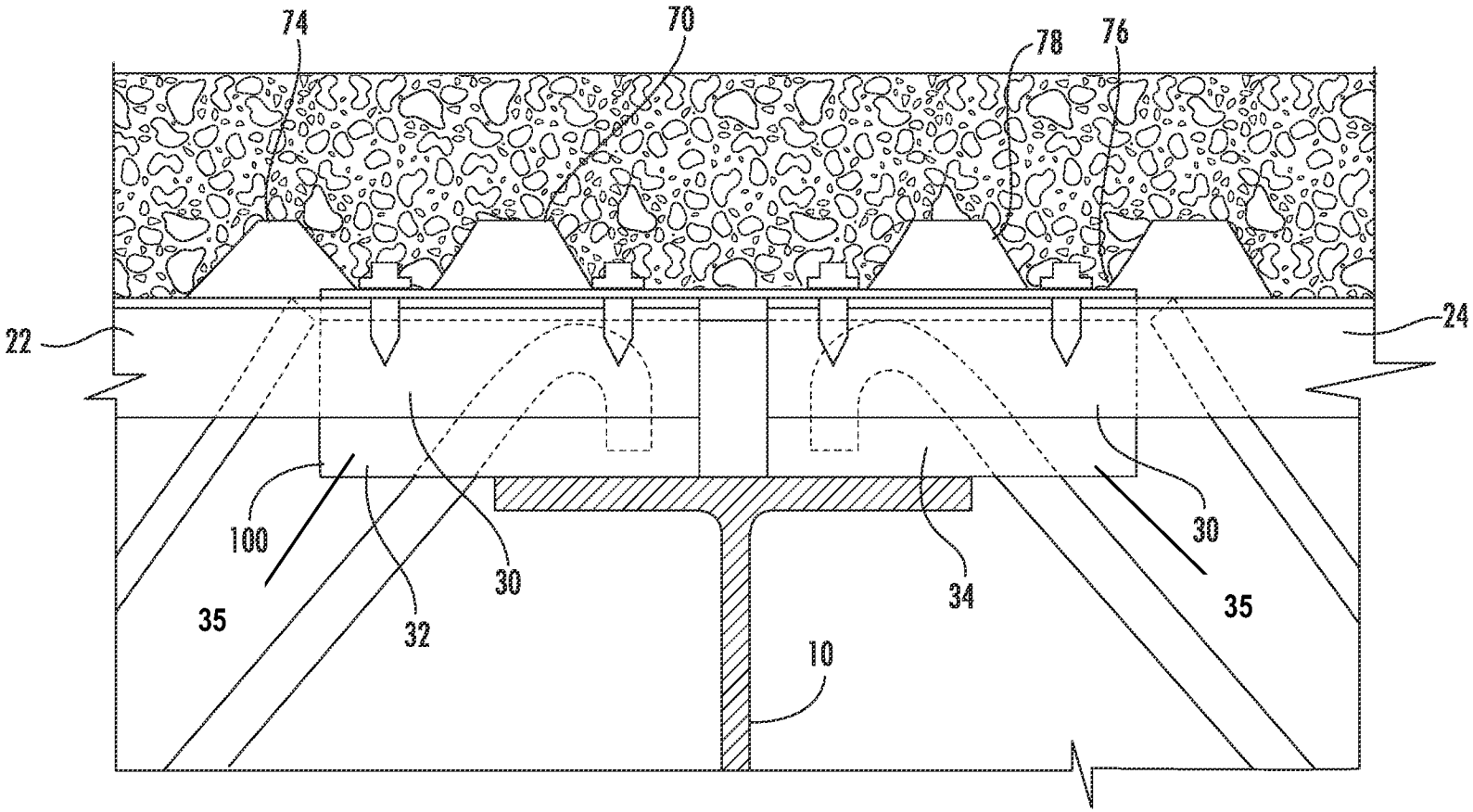
FIG. 14 illustrates a side cross-sectional view of the structural decking system, in accordance with embodiments of the present disclosure.

FIG. 11 illustrates a tie installation process 200 for installing a decking system 1 using the tie 100 described herein, in order to operatively couple a first joist 22 with a second joist 24 at a location on a support member 10 to facilitate axial load transfer between the joists 20, to reduce the amount of connections, and/or to reduce the assembly time of the decking system 10. FIGS. 12-14 further illustrate the decking systems at different points of the installation process, as will be discussed with respect to the process 200 described in FIG. 11.

As illustrated by block 202 in FIG. 11, one or more first joists 22 are assembled to one or more support members 10. For example, a proximal end 26 of a first joist 22 may be assembled to a first support member 12, while a distal end 28 of one or more first joists 22 may be assembled to a second support member 14, as illustrated by the plurality of joists 20 illustrated in FIG. 12.

Block 204 of FIG. 11 illustrates that one or more second joists 24 are assembled to one or more support members 10. For example, a proximal end 26 of a second joist 22 may be assembled to a first support member 12, while a distal end 28 of the one or more second joists 24 may be assembled to a third support member 16 (not illustrated). It should be understood that the one or more first joists 22 and/or one or more second joists 24 (e.g., the plurality of joists 20) may be assembled to the one or more support members 10 through the use of connectors (e.g., weld, fastener, such as a screw, bolt, nut, pin, nail, rivet, or other like fastener, or other like connector) at the joist seats 30 of the joists 20. It should be further understood that the one or more joists 20 may be lifted into place individually onto the support members 10 on the building, as the building is being assembled, or alternatively, two or more joists 20 (e.g., a plurality of first joists 22) may be assembled together in a panelized system (e.g., the two or more joists may be connected by cross-bracing and/or to a support member 10) before the two or more joists 20 are lifted onto the support structures of the building (e.g., before or after being operatively coupled to a support members).

As illustrated by block 206 of FIG. 11, the tie 100 is assembled to the proximal end 26 of the first joist 22 and the proximal end 26 of the second joist 24 by placing the tie 100 over the ends 26 of the first joist 22 and the second joist 24 (e.g., first joist seat 32 and second joist seat 34). For example, in some embodiments of the invention the one or more ribs 120 of the tie 100 are located within the cavities 60 of the first joist 22 and the second joist 24 (e.g., a first cavity 62 and a second cavity 64). Additionally, or alternatively, the tie cavity 130 created by the tie web 110 and the one or more tie flanges (e.g., a first tie flange 112 and a second tie flange 114, or the like) extends around the joist seats 30 of the first joist 22 and second joist 24. It should be understood that due at least in part to the shape of the tie 100, the tie 100 may be placed over the joists 30 without making any connections of the tie 100 to the joists 30 and/or the support members 10. That is the tie cavity 130 and/or one or more ribs 120 located in the cavities 60 of the first joist 22 and the second joist 24, keep the tie 100 in place until the decking can be assembled. Moreover, it should be understood that depending on the shape of the tie 100, and/or the shape and/or location of the ribs 120 (e.g., ribs in the one or more flanges, or the like) the tie 100 may be placed over the joists 20 vertically, may require rotating the tie into place (e.g., in order to hook a rib 120 in a flange around the joist 20, such as for the ties 100 illustrated in FIGS. 9D-9F), or the like. Furthermore, while in some embodiments the ties 100 do not require connections to the support member 10 and/or joists 20, it should be understood that the ties 100 (e.g., through a connection with the one or more flanges, or the like) may have one or more connections with the support member 10 and/or the joists 20.

Block 208 of FIG. 11 illustrates that one or more structural decking panels 70 may be assembled to the system over the joists 20 and the ties 100. It should be understood that the structural decking 70 may have profiles that include top flanges 74 (otherwise described as peaks, upper flanges, outer flanges, or the like), bottom flanges 76 (otherwise described as troughs, lower flanges, inner flanges, or the like), and webs 78 (e.g., the portions of the panel that are sloped, perpendicular, or generally perpendicular with the flanges 74, 76) that operatively couple the top flanges 74 to the bottom flanges 76. The combination of top and bottom flanges 74, 76, and the webs 78 create a flute for the structural decking 2. The profiles may be referred to as "fluted profiles," "hat profiles", "flat-bottomed profiles", "triangular profiles," "trapezoidal profiles," "dovetail profiles," or other like profiles. The distance from the top of the top flange 74 and the bottom of the bottom flange 76 may generally range from a ½ inch to 3 inches in depth; however, other ranges of depths within this range, overlapping this range, or outside of this range may be used in the profiles. For example, in some embodiments the distance may range from ½ inch to 12 inches in depth, or the like. The decking 70 may or may not include longitudinal ribs, bends, or cutouts that impact the moment of inertia and section modulus of the structural decking 70 (e.g., profile dimensions, ribs, cutouts, or the like are used to target different performance characteristics, such as but not limited to strength and/or stiffness). Depending on the material thickness, the length and width of the decking 70, and the height of the top flanges 74 and bottom flanges 76, the decking 70 may weigh between 100 and 420 lbs. In other embodiments, the weight of the decking panels 70 may be within, overlap, or be located outside of this range. Each structural decking panel 70 may be formed (e.g., roll-formed, or the like) into the desired profile.

Decking edges 79 (e.g., the opposite longer sides of the structural panel 70) may be formed into lips that couple a first structural panel 70 to an adjacent second structural panel 70. The lips on opposite edges 79 of a structural panel 70 may create sidelaps between the panels. The sidelaps may be overlapping in-plane sidelaps, out of plane sidelap seams (e.g., male and female standing lips that create a standing sidelap seam), in-plane nested sidelaps, or the like. The sidelaps may have two, three, four, or more layers, or the like. Couplings (also described as joints, connections, attachments, or the like) may be formed in the sidelap of the structural decking panels 70 to couple adjacent structural panels 70 to each other using connectors (e.g., fasteners, welds, or the like as discussed herein).

In order to couple two adjacent structural decking panels 70 together, a first edge of a first structural decking panel may receive a second edge of a second structural decking panel. The first edge may be placed over the second edge to create an un-joined sidelap 70 along the length of adjacent structural decking panel edges 79. The purpose of the sidelap 79 formed after coupling (e.g., utilizing a connector, such as a fastener, deforming or displacing, cutting, and/or forming, welding, or the like) is to couple two adjacent structural decks 70 securely to each other in order to prevent one decking panel from separating transversely from another decking panel (e.g., lifting vertically off another panel in a horizontal roof or floor installation, preventing in-plane movement (e.g., shifting of the panels along the sidelap) between the adjacent structural panels 70, and providing the desired shear strength of the structural system. FIG. 13 illustrates a decking system 1 with the concrete, one or more decking panels 70, and a second joists 24 removed.

Block 210 of FIG. 11 illustrates that the structural decking 70 may be secured to the joists 20 and the tie 100 after the decking 70 has been placed over the joists 20 and the tie 100. For example, as previously discussed, because of the shape of the tie 100, the tie 100 may have improved strength, and thus, the thickness of the tie 100 may be reduced (e.g., when compared to plates, or other axial transfer members). As such, the tie 100 may have a reduced thickness that allows for one or more connectors that operatively couple the decking 70, the tie 100, and the joists 20 (i.e., the first joist seat 32 and/or the second joist seat 34) at each connector location (e.g., a single connector at each location that couples the decking 70, the tie 100, and the joists 20 together). In some embodiments, it should be understood that connectors may be one or more fasteners that operatively couple the decking 70 to the joists (e.g., joist connectors), and/or one or more fasteners that operatively couple the decking 70 to the tie 100 and to the joist seat 30 (e.g., joist seat connectors). As such, the fastener may extend through the decking 70 (e.g., bottom flange 76 of the decking), the tie 100 (e.g., the tie web 110), and the joist seat 30 (e.g., top portion of the joist seat 30, such as a first angle member 52 or a second angle member 54 of the joist seat 30). For example, FIG. 14 illustrates some embodiments of the invention in which the decking is operatively coupled to the tie 100 and the upper chord 42 of the joist seat 30 by each connector (e.g., a fastener).

Block 212 of FIG. 11 illustrates that concrete 90 and/or other members for the building may be assembled over the decking 70 and/or the support members 10.

The decking system 1 of the present invention utilizing the tie 100 described herein provides a number of benefits over traditional systems. For example, the decking system 1 of the present disclosure may be assembled more quickly through the use of the tie 100 when compared to traditional decking systems. That is, traditional systems require making additional connections between thick metal plates and the joists (e.g., joist seats), and then between the decking and the thick metal plates. For example, thick metal plates (e.g., with pre-drilled holes, or the like) may be fastened to joists (e.g., joists seats) through the use of fasteners; however, when the decking is assembled over the thick metal plates, the metal plates alone or in combination with the joists, are too thick to utilize a single fastener through the decking, metal plate, and joists. As such, traditional systems typically require welding the decking to the thick metal plates. Unlike traditional decking systems, the tie 100 of the present disclosure is much thinner than the traditional metal plates, as such, a single connector (e.g., fastener, or the like) may be used to operatively couple the decking, tie 100, and joists seat 30 (e.g., see FIG. 14). For example, a single fastener (e.g., self-drilling fasteners, or the like) may be able to penetrate the decking, tie 100, and joist seat 30. Furthermore, due to the thickness of the metal plates, traditional decking systems include a decking "bump", such as a rise in the decking of 1, 0.9, 0.8, 0.7, 0.6, 0.5, 0.4, 0.3, or the like inches, where the decking overlays the metal plates at the joist seat locations. Unlike traditional decking systems, the thickness of the tie 100 is reduced such that any rise the decking at the location of the tie 100 is minimal, such as less than or equal to 0.25, 0.2, 0.15, 0.1 inches, or the like. Consequently, the decking system 1 and tie 100 of the present disclosure results in a system that that does not have (or only has minimal) deformation of the decking or elevated decking at the tie 100 locations. The decking system 1 of the present disclosure also provides improved safety because it requires less connections, such that the time erectors are on the building assembling the decking system 1 is reduced. Finally, while the tie 100 has a reduced thickness it provides the same or improved axial load transfer between adjacent joists because of the shape of the tie 100 (e.g., ribs 120, flanges, or the like).

It should be understood that the tie 100 may be made in a number of different ways. For example, the tie 100 may be stamped, rolled, bent, and/or the like in order to create the tie web 110, the one or more ribs 120, and/or the one or more flanges that form or define the tie cavity 130.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" shall mean "one or more."

Certain terminology is used herein for convenience only and is not to be taken as a limiting, unless such terminology is specifically described herein for specific embodiments. For example, words such as "top", "bottom", "upper", "lower", or the like may merely describe the configurations shown in the Figures and described herein for some embodiments of the invention. Indeed, the components may be oriented in any direction and the terminology, therefore, should be understood as encompassing such variations unless specified otherwise. The terminology includes the words specifically mentioned above, derivatives thereof and words of similar import.

While certain exemplary embodiments have been described and shown in the accompanying drawings, it is to be understood that such embodiments are merely illustrative of and not restrictive on the broad invention, and that this invention not be limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A structural decking system, comprising:

one or more support members;

a first joist having:

a first upper chord, wherein the first upper chord comprise two first angle members operatively coupled together;

a first lower chord; and a plurality of first webs operatively coupling the first upper chord and the first lower chord;

wherein the first joist has first opposing ends and at least one first joist seat, wherein the first joist seat is formed from the two first angle members of the first upper chord directly operatively coupled to a first lower seat chord or the first joist seat is separate from the first upper chord and formed from at least two first seat members that are operatively coupled to a first web of the plurality of first webs, and wherein the first joist seat has a first cavity with a first opening formed between the two first angle members of the first upper chord or from the at least two first seat members;

a second joist having:

a second upper chord, wherein the second upper chord comprises two second angle members operatively coupled together;

a second lower chord; and a plurality of second webs operatively coupling the second upper chord to the second lower chord;

wherein the second joist has second opposing ends and at least one second joist seat, wherein the second joist seat is formed from the two second angle members of the second upper chord directly operatively coupled to a second lower seat chord or the second joist seat is separate from the second upper chord and formed from at least two second seat members that are operatively coupled to a second web of the plurality of second webs, and wherein the second joist seat has a second cavity with a second cavity opening formed between the two second angle members of the second upper chord or from the at least two second seat members; wherein a first proximal end of the first joist and a second proximal end of the second joist are operatively coupled to a first support member in series;

a joist tie comprising a tie web having one or more ribs, wherein the one or more ribs have a width less than the first cavity opening of the first cavity and the second cavity opening of the second cavity;

wherein the joist tie is operatively coupled to the first proximal end of the first joist and the second proximal end of the second joist, wherein a first portion of the one or more ribs of the joist tie is located within the first cavity of the first joist seat and a second portion of the one or more ribs of the joist tie is located within the second cavity of the second joist seat;

decking extending over the joist tie and a portion of the first joist and the second joist, and one or more connectors, wherein the one or more connectors comprise:

one or more fasteners, wherein the one or more fasteners operatively couple the decking, the joist tie, and the first proximal end of the first joist or the second proximal end of the second joist by extending through the decking, the tie web, and first proximal end of the first joist or the second proximal end of the second joist; or wherein the one or more connectors are one or more welds that operatively couple the joist tie to the first proximal end of the first joist or the second proximal end of the second joist before installing the decking over the joist tie; and wherein the joist tie minimizes any rise in the decking at the location of the joist tie to a tie web thickness of the joist tie.

2. The system of claim 1, wherein the tie web comprises a single rib, wherein the joist tie further comprises:

one or more tie flanges operatively coupled to the tie web.

3. The system of claim 2, wherein the one or more tie flanges comprise a first tie flange operatively coupled to the tie web and a second tie flange operatively coupled to the tie web, wherein the first tie flange, the tie web, and the second tie flange form a tie cavity having a tie width that is greater than a joist width of the first joist seat of the first joist and the second joist seat of the second joist.

4. The system of claim 3, wherein the one or more tie flanges comprise a third tie flange operatively coupled to the first tie flange, and a fourth tie flange operatively coupled to the second tie flange, and wherein the third tie flange and the fourth tie flange are operatively coupled to the one or more support members.

5. The system of claim 4, wherein the first tie flange and the second tie flange are generally perpendicular with the tie web, and wherein the third tie flange and the fourth tie flange are generally perpendicular with the first tie flange and the second tie flange.

6. The system of claim 5, wherein the first tie flange and the second tie flange are substantially perpendicular with the tie web, and wherein the third tie flange and the fourth tie flange are substantially perpendicular with the first tie flange and the second tie flange.

7. The system of claim 6, wherein the first tie flange and the second tie flange are perpendicular with the tie web, and wherein the third tie flange and the fourth tie flange are perpendicular with the first tie flange and the second tie flange.

8. The system of claim 1, wherein the one or more ribs comprise a single rib extending a length of the joist tie, wherein the first portion of the single rib of the joist tie is located within the first cavity of the first joist seat and the second portion of the single rib of the joist tie is located within the second cavity of the second joist seat.

9. The system of claim 1, wherein the one or more ribs comprise two or more ribs extending over at least a portion of a length of the joist tie, wherein the first portion of the two or more ribs comprises a first rib that is located within the first cavity of the first joist seat, and wherein the second portion of the two or more ribs comprises a second rib that is located within the second cavity of the second joist seat.

10. The system of claim 1, wherein the one or more ribs have a height that is greater than the tie web thickness of the tie web.

11. The system of claim 1, the tie web thickness of the tie web ranges from 0.15 to 0.25 inches, inclusive, wherein the rise in the decking at the location of the joist tie is less than 0.25 inches.

12. The system of claim 1, wherein the one or more connectors are the one or more fasteners.

13. The system of claim 1, wherein the at least two first seat members and the at least two second seat members each comprise two joist seat angle members operatively coupled together.

14. The system of claim 1, wherein the first joist seat is formed from the first upper chord and the first lower seat chord, and wherein the second joist seat is formed from the second upper chord and the second lower seat chord.

15. A joist tie comprising:

a tie web;

a first tie flange operatively coupled to the tie web;

a second tie flange operatively coupled to the tie web; and one or more ribs in the tie web;

wherein the joist tie is configured to be operatively coupled to a first proximal end of a first joist and a second proximal end of a second joist of a decking system, the first joist having:

a first upper chord, wherein the first upper chord comprise two first angle members operatively coupled together;

a first lower chord; and a plurality of first webs operatively coupling the first upper chord and the first lower chord;

wherein the first joist has first opposing ends and at least one first joist seat, wherein the first joist seat is formed from the two first angle members of the first upper chord directly operatively coupled to a first lower seat chord or the first joist seat is separate from the first upper chord and formed from at least two first seat members that are operatively coupled to a first web of the plurality of first webs, and wherein the first joist seat has a first cavity with a first opening formed between the two first angle members of the first upper chord or from the at least two first seat members; and the second joist having:

a second upper chord, wherein the second upper chord comprises two second angle members operatively coupled together;

a second lower chord; and a plurality of second webs operatively coupling the second upper chord to the second lower chord;

wherein the second joist has second opposing ends and at least one second joist seat, wherein the second joist seat is formed from the two second angle members of the second upper chord directly operatively coupled to a second lower seat chord or the second joist seat is separate from the second upper chord and formed from at least two second seat members that are operatively coupled to a second web of the plurality of second webs, and wherein the second joist seat has a second cavity with a second cavity opening formed between the two second angle members of the second upper chord or from the at least two second seat members;

wherein the one or more ribs of the joist tie have a width less than the first cavity opening of the first cavity and the second cavity opening of the second cavity; and wherein a first portion of the one or more ribs is configured to be operatively coupled within the first cavity of the first joist seat and a second portion of the one or more ribs is configured to be operatively coupled within the second cavity of the second joist seat;

wherein the joist tie is configured to allow for operatively coupling the joist tie to the first proximal end of the first joist and the second proximal end of the second joist using one or more connectors, wherein the one or more connectors comprise:

one or more fasteners, wherein the one or more fasteners are configured to operatively couple a decking, the joist tie, and the first proximal end of the first joist or the second proximal end of the second joist by extending through the decking, the tie web, and first proximal end of the first joist or the second proximal end of the second joist; or one or more welds that are configured to operatively couple the joist tie to the first proximal end of the first joist or the second proximal end of the second joist before installing the decking over the joist tie; and wherein a tie web thickness of a tie web ranges from 0.15 to 0.25 inches, inclusive and is configured to minimize any rise in the decking at the location of the joist tie to less than 0.25 inches when the decking is installed over the joist tie and a portion of the first joist and a portion of the second joist.

16. The joist tie of claim 15, wherein the one or more connectors are the one or more fasteners.

17. The joist tie of claim 15, further comprising: a third tie flange operatively coupled to the first tie flange, and a fourth tie flange operatively coupled to the second tie flange.

18. The joist tie of claim 15, wherein the one or more ribs comprises a single rib extending a length of the joist tie, wherein the first portion of the single rib of the joist tie is located within the first cavity and the second portion of the single rib of the joist tie is located within the second cavity.

19. The joist tie of claim 15, wherein the one or more ribs comprise two or more ribs extending over at least a portion of a length of the joist tie.

20. A method of assembling a structural decking system, the method comprising:

assembling a first joist having first opposing ends and at least one first joist seat to one or more support members, wherein the first joist comprises:

a first upper chord, wherein the first upper chord comprise two first angle members operatively coupled together;

a first lower chord; and a plurality of first webs operatively coupling the first upper chord and the first lower chord; and wherein the first joist seat is formed from the two first angle members of the first upper chord directly operatively coupled to a first lower seat chord or the first joist seat is separate from the first upper chord and formed from at least two first seat members that are operatively coupled to a first web of the plurality of first webs, and wherein the first joist seat has a first cavity with a first opening formed between the two first angle members of the first upper chord or from the at least two first seat members; and assembling a second joist having second opposing ends and at least one second joist seat to the one or more support members, wherein the second joist comprises:

a second upper chord, wherein the second upper chord comprises two second angle members operatively coupled together;

a second lower chord; and a plurality of second webs operatively coupling the second upper chord to the second lower chord; and wherein the second joist seat is formed from the two second angle members of the second upper chord directly operatively coupled to a second lower seat chord or the second joist seat is separate from the second upper chord and formed from at least two second seat members that are operatively coupled to a second web of the plurality of second webs, and wherein the second joist seat has a second cavity with a second cavity opening formed between the two second angle members of the second upper chord or from the at least two second seat members; and assembling a joist tie, comprising a tie web having one or more ribs, to a first proximal end of the first joist and a second proximal end of the second joist, wherein the one or more ribs have a width less than the first cavity opening of the first cavity and the second cavity opening of the second cavity wherein the first proximal end of the first joist is operatively coupled to the second proximal end of the second joist in series, and wherein a first portion of the one or more ribs of the joist tie is located within the first cavity of the first joist seat and a second portion of the one or more ribs of the joist tie is located within the second cavity of the second joist seat assembling decking over the joist tie and the first joist and the second joist;

assembling one or more connectors, wherein the one or more connectors comprise:

one or more fasteners, wherein the one or more fasteners are configured to operatively couple the decking, the joist tie, and the first proximal end of the first joist or the second proximal end of the second joist by extending through the decking, the tie web, and first proximal end of the first joist or the second proximal end of the second joist; or one or more welds that are configured to operatively couple the joist tie to the first proximal end of the first joist or the second proximal end of the second joist before installing the decking over the joist tie; and wherein the joist tie minimizes any rise in the decking at the location of the joist tie to a tie web thickness of the joist tie.

21. The method of claim 20, wherein the one or more connectors comprise the one or more fasteners.

* * * * *